US009624710B2

(12) United States Patent
Bowman et al.

(10) Patent No.: US 9,624,710 B2
(45) Date of Patent: Apr. 18, 2017

(54) DOOR OPERATING SYSTEM

(71) Applicant: Door Engineering and Manufacturing, LLC, Kasota, MN (US)

(72) Inventors: Dustin Bowman, Mankato, MN (US); Kevin Landgraff, Eagle Lake, MN (US); Christopher Adams, Eagle Lake, MN (US); Michael Tenney, Mankato, MN (US)

(73) Assignee: Door Engineering and Manufacturing, LLC, Kasota, MN (US)

( * ) Notice: Subject to any disclaimer, the term of this patent is extended or adjusted under 35 U.S.C. 154(b) by 80 days.

(21) Appl. No.: 14/243,371

(22) Filed: Apr. 2, 2014

(65) Prior Publication Data

US 2014/0299280 A1 Oct. 9, 2014

Related U.S. Application Data

(60) Provisional application No. 61/870,900, filed on Apr. 3, 2013.

(51) Int. Cl.
*E05D 15/26* (2006.01)
*E05F 17/00* (2006.01)
(Continued)

(52) U.S. Cl.
CPC ..... *E05F 17/004* (2013.01); *E05F 15/51* (2015.01); *E05Y 2201/624* (2013.01); *E05Y 2900/106* (2013.01); *E06B 3/481* (2013.01)

(58) Field of Classification Search
CPC ..... E05F 17/004; E05F 15/605
(Continued)

(56) References Cited

U.S. PATENT DOCUMENTS 1,630,127 A * 5/1927 Martindale ..... E05F 15/605 160/118
1,760,062 A * 5/1930 Hynes ..... E05F 15/605 49/28

(Continued)

OTHER PUBLICATIONS

Door Engineering and Manufacturing, LCC, The Show Door, Apr. 21, 2010, Las Vegas, United States.

(Continued)

*Primary Examiner* — David Purol
*Assistant Examiner* — Jeremy Ramsey
(74) *Attorney, Agent, or Firm* — Moore & Hansen, PLLC; Robert C. Freed

(57) ABSTRACT

A door operating system or door opening and closing apparatus comprising at least one motive source, a linkage assembly and a door. Preferred door operating systems will include two linkage assemblies, two doors and two motive sources, one for each door. Each motive source is preferably attached to an interior facing surface of a frame of a structure and the door is pivotally attached to an exterior facing surface of the frame of a structure. Each linkage assembly operatively connects the respective motive source to the respective door. By having the motive source attached to the interior facing surface of the frame, doors of the operating system can preferably be opened the full width of the frame opening to maximize available vehicle clearance.

21 Claims, 20 Drawing Sheets

(51) Int. Cl.
*E05F 15/51* (2015.01)
*E06B 3/48* (2006.01)

(58) Field of Classification Search
USPC ..... 160/118, 199, 206, 210, 212, 213; 49/108, 324, 340; 403/109.1–109.3
See application file for complete search history.

(56) References Cited

U.S. PATENT DOCUMENTS

| | | | | |
|---|---|---|---|---|
| 1,796,582 | A * | 3/1931 | Stoven | E05F 15/605 122/6 A |
| 3,138,474 | A * | 6/1964 | Reiss | E05D 15/264 160/206 |
| 3,734,441 | A * | 5/1973 | Lux | F16B 2/246 135/909 |
| 8,341,889 | B2 * | 1/2013 | Faulkner | E05F 15/63 49/339 |
| 2008/0216408 | A1 * | 9/2008 | Letkeman | E05D 15/264 49/340 |
| 2012/0291354 | A1 * | 11/2012 | Giannis | E05F 15/63 49/324 |
| 2014/0259939 | A1 * | 9/2014 | Collinson | E05F 15/103 49/340 |

OTHER PUBLICATIONS

Door Engineering and Manufacturing, LCC, 10094F, Nov. 11, 2010, Kesota, United States.
Door Engineering and Manufacturing, LCC, 11104F Rev. A, Sep. 20, 2011, Kesota, United States.

* cited by examiner

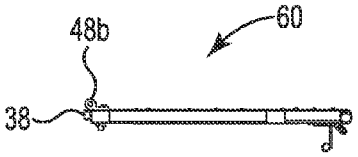
Fig. 7d
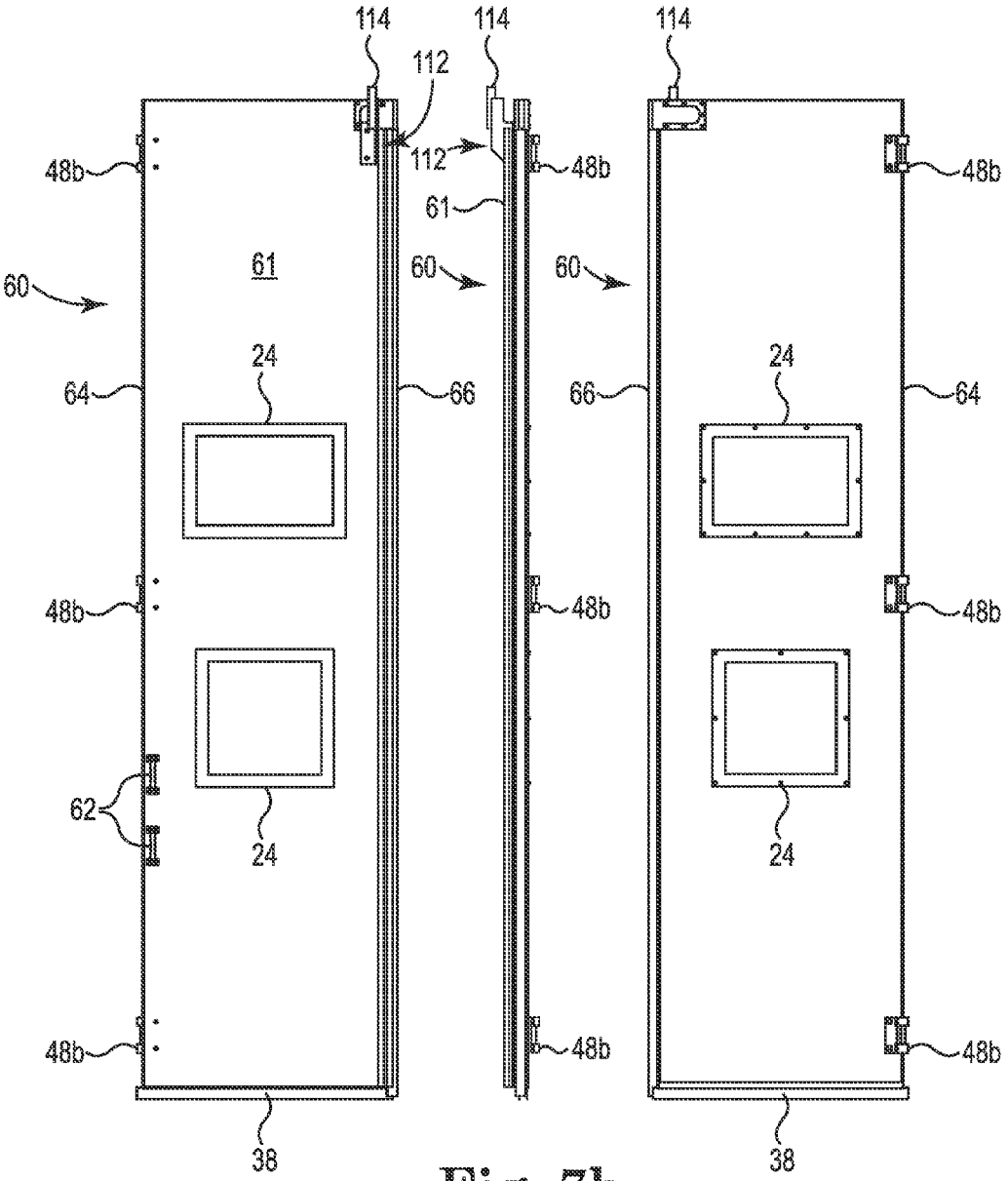
Fig. 7a
Fig. 7b
Fig. 7c

DOOR OPERATING SYSTEM

RELATED APPLICATIONS

The present application claims benefit under 35 U.S.C. 119(e) of U.S. provisional application Ser. No. 61/807,900, filed Apr. 3, 2013, which is hereby incorporated herein by reference.

FIELD OF THE INVENTION

The present invention relates to door operating systems for opening and closing doors. The invention more specifically relates to door operating systems for facilities.

BACKGROUND OF THE DISCLOSURE

Many vehicle storage facilities or other types of facilities built decades ago, for example fire house garages, require upgrading of door operating systems. It can be difficult to retrofit such buildings as generally vehicle size has increased over the years, thus leaving little space for the door panels to swing to the interior side of the door opening.

The present invention addresses problems and limitations associated with the related art.

SUMMARY OF THE INVENTION

Preferred embodiments include a door operating system or door opening and closing apparatus comprising at least one motive source, a linkage assembly and, optionally, a door. As it will be understood, disclosed door operating systems can be used with new door installations as well as retrofitting of door operating systems in which the existing door is used. Preferred door operating systems will include two linkage assemblies, two doors and two respective motive sources, one for each door. Each motive source is preferably attached to an interior facing surface of a frame of a structure and the respective door is pivotally attached to an exterior facing surface of the frame of a structure. Each linkage assembly operatively connects the respective motive source to the respective door. By having the motive source attached to the interior facing surface of the frame, doors used with the operating system can preferably be opened the full width of the frame opening to maximize available clearance (e.g. vehicle clearance).

The disclosure further includes methods of powering a replacement door that has been operatively connected to an exterior surface of a jamb of a structure having a jamb and a header. The preferred method of powering a replacement door includes providing a motive source, providing a linkage assembly, connecting the motive source to the header of the structure, connecting the motive source to one end of a linkage assembly; and then connecting another end of the linkage assembly to an interior facing side of the door.

Although the disclosure may discuss embodiments and methods in the context of retrofitting, it should be understood that the disclosed designs can also be used in new-construction buildings.

These and various other advantages and features of novelty which characterize the present invention are pointed out with particularity in the claims annexed hereto and forming a part hereof. However, for a better understanding of the invention, its advantages and objects obtained by its use, reference should be made to the drawings which form a further part hereof, and to the accompanying descriptive matter, in which there is illustrated and described a preferred embodiment of the present invention.

BRIEF DESCRIPTION OF THE DRAWINGS

In the drawings, in which corresponding reference numerals and letters indicate corresponding parts of the various embodiments throughout the several views, and in which the various embodiments generally differ only in the manner described and/or shown:

FIG. 7*a* is an exterior view of a preferred left fold panel 60 of bi-fold door 20 of FIGS. 1-4*c;*

FIG. 7*b* is a side view of the preferred left fold panel 60 of bi-fold door 20 of FIGS. 1-4*c;*

FIG. 7*c* is an interior view of the preferred left fold panel 60 of bi-fold door 20 of FIGS. 1-4*c;*

FIG. 7*d* is a top view of the preferred left fold panel 60 of bi-fold door 20 of FIGS. 1-4*c;*

DETAILED DESCRIPTION OF THE PREFERRED EMBODIMENTS

Figure 1:
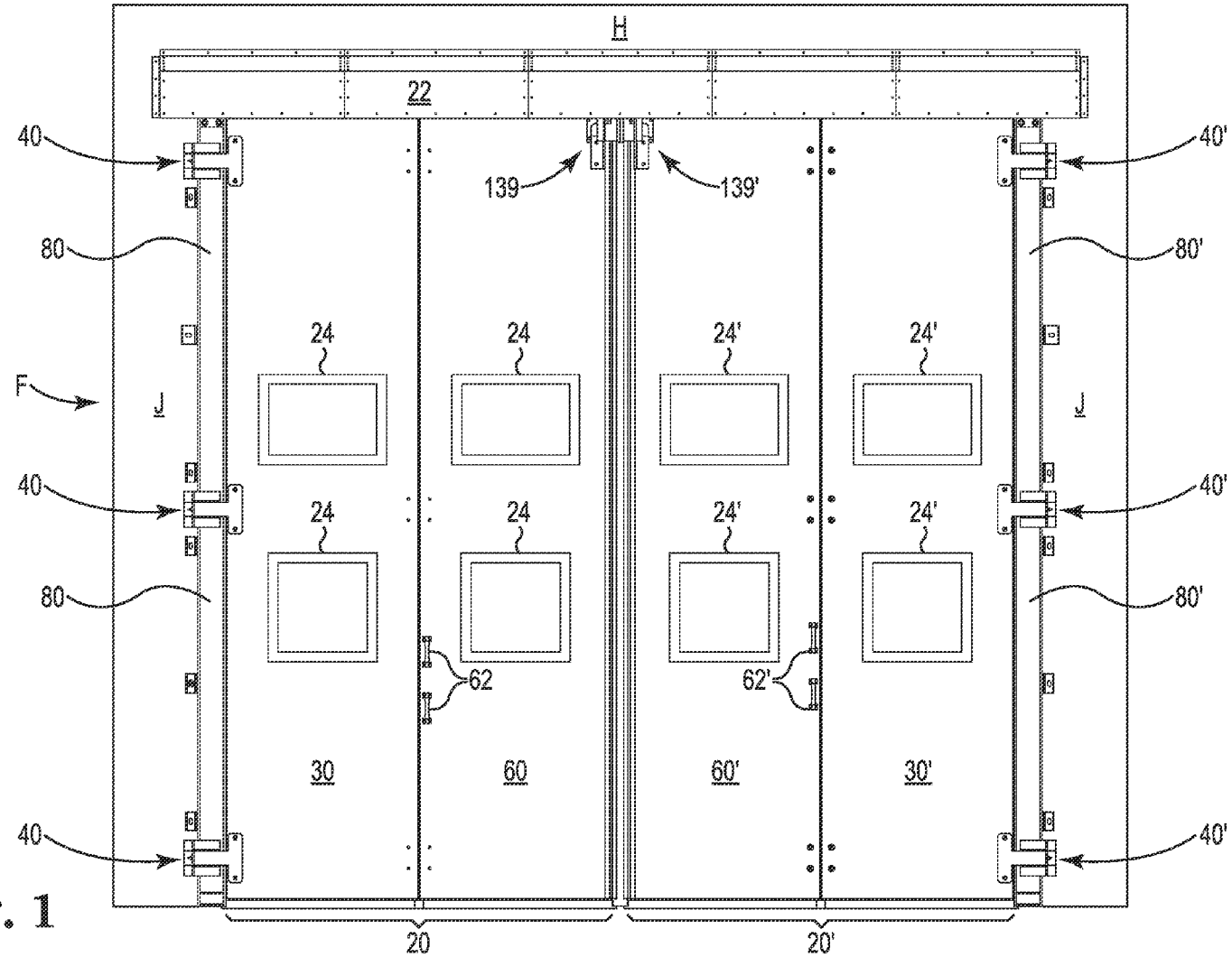
FIG. 1 is an exterior view of an embodiment of a door operating system 10 in which two bi-fold doors 20, 20' have been retrofitted to an existing door frame F.

FIGS. 1-12*f* illustrate the components of one preferred door operating system 10. FIG. 1 depicts an exterior view of an embodiment of a door operating system 10 in which two bi-fold doors 20, 20' have been retrofitted to an existing door frame F of a structure that may already have a header H and jambs J. It will be understood that the doors 20, 20' need not be bi-fold. The leftmost bi-fold door 20, which includes a jamb panel 30 and a fold panel 60, is movably connected to a secondary left jamb frame 80, while the rightmost bi-fold door 20', which includes a jamb panel 30' and a fold panel 60', is movably connected to a secondary right jamb frame 80'. Preferably, the left jamb panel 30 and the right jamb panel 30' are pivotally connected to a respective secondary jamb frame 80, 80'. As depicted, each jamb panel 30, 30' includes three hinges 40, 40', which are preferably mounted to the exterior surfaces of the jamb panels 30, 30' and respective secondary jamb frames 80, 80'. It will be appreciated that the number of hinges 40, 40' could be more or less, depending upon the size of the bi-fold doors 20, 20'. The fold panels 60, 60' may be provided with one or more hand grips 62,62' to facilitate manual operation of the bi-fold doors 20, 20'. A hood 22 may be attached to the existing header H, with the hood 22 projecting forwardly therefrom so that it is able to protect exterior portions of the door operating system 10 from inclement weather, debris, animals, and etcetera. Each jamb panel 30, 30' and fold panel 60, 60' of the bi-fold doors 20, 20' may be provided with one or more windows 24, if desired.

Figure 2:
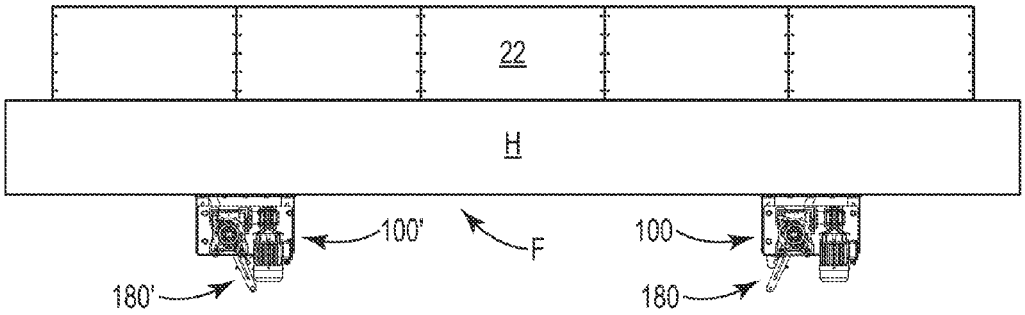
FIG. 2 is a top view of the door operating system 10 of FIG. 1.
Figure 3:
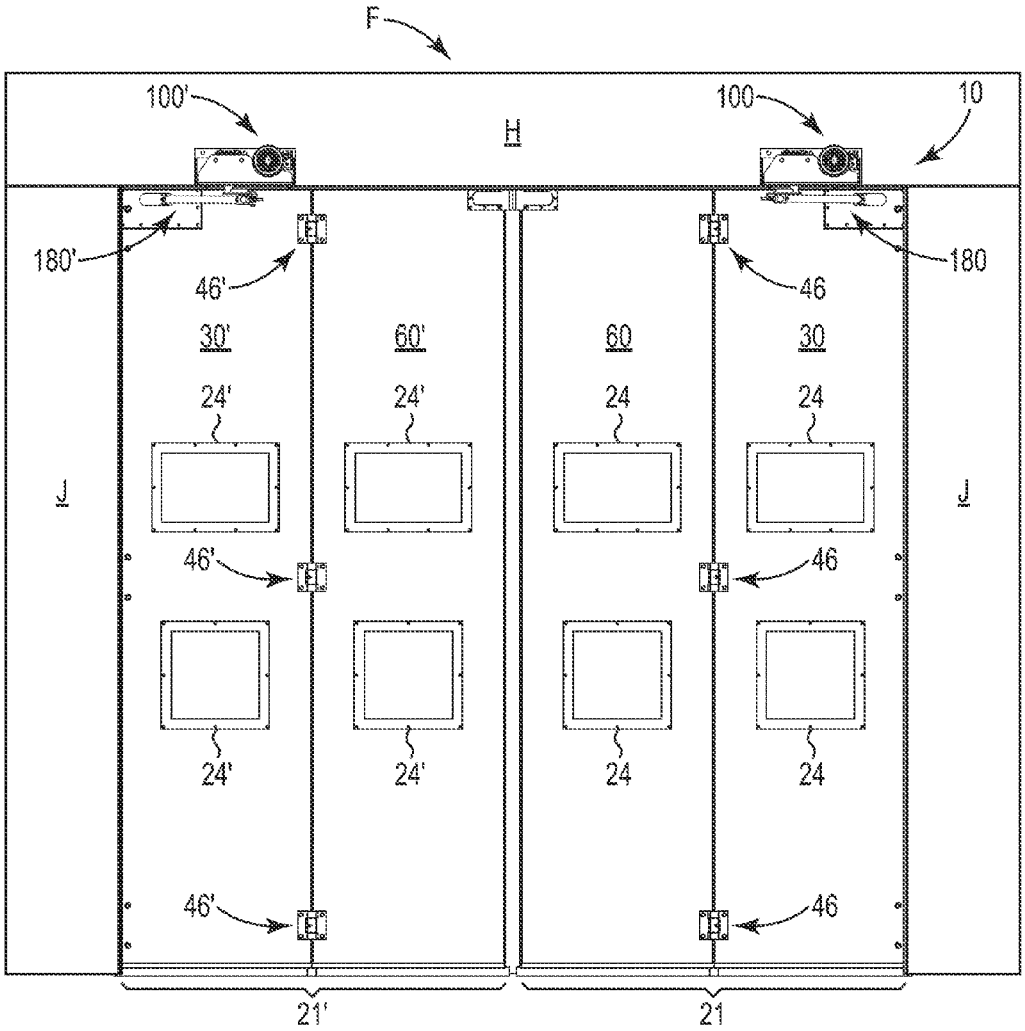
FIG. 3 is an interior plan view of the door operating system 10 of FIGS. 1-2.

FIGS. 2 and 3 depict an interior view and a top plan view, respectively, of the door operating system 10 of FIG. 1 (note that in FIG. 2 the left and right sides are reversed to be consistent with FIG. 1). In FIG. 2 movable connections between the jamb panels 30, 30' and fold panels 60, 60' can be seen. Preferably, the jamb panels 30, 30' and fold panels 60, 60' of each bi-fold door 20, 20' are pivotally connected to each other. As depicted, there are three hinges 46, 46' that connect each jamb panel 30, 30' to its respective fold panel 60, 60', and preferably, the hinges 46, 46' are mounted to the interior surfaces of the respective jamb panel 30, 30' and fold panels 60, 60'. As will be understood, the number of hinges 46, 46' could be more or less, depending upon the size of the bi-fold doors 20, 20'. Each bi-fold door 20, 20' is operatively connected to a respective motive source 100, 100', which may be secured to the header H of the existing door frame F. As depicted, the motive sources 100, 100' advantageously positioned such that it is adjacent to and slightly higher than a top end of the respective jamb panel 30, 30'. As will be discussed later, such positioning enables each motive source 100, 100' to be operatively connected to the bi-fold door 20, 20'.

Figure 4A:
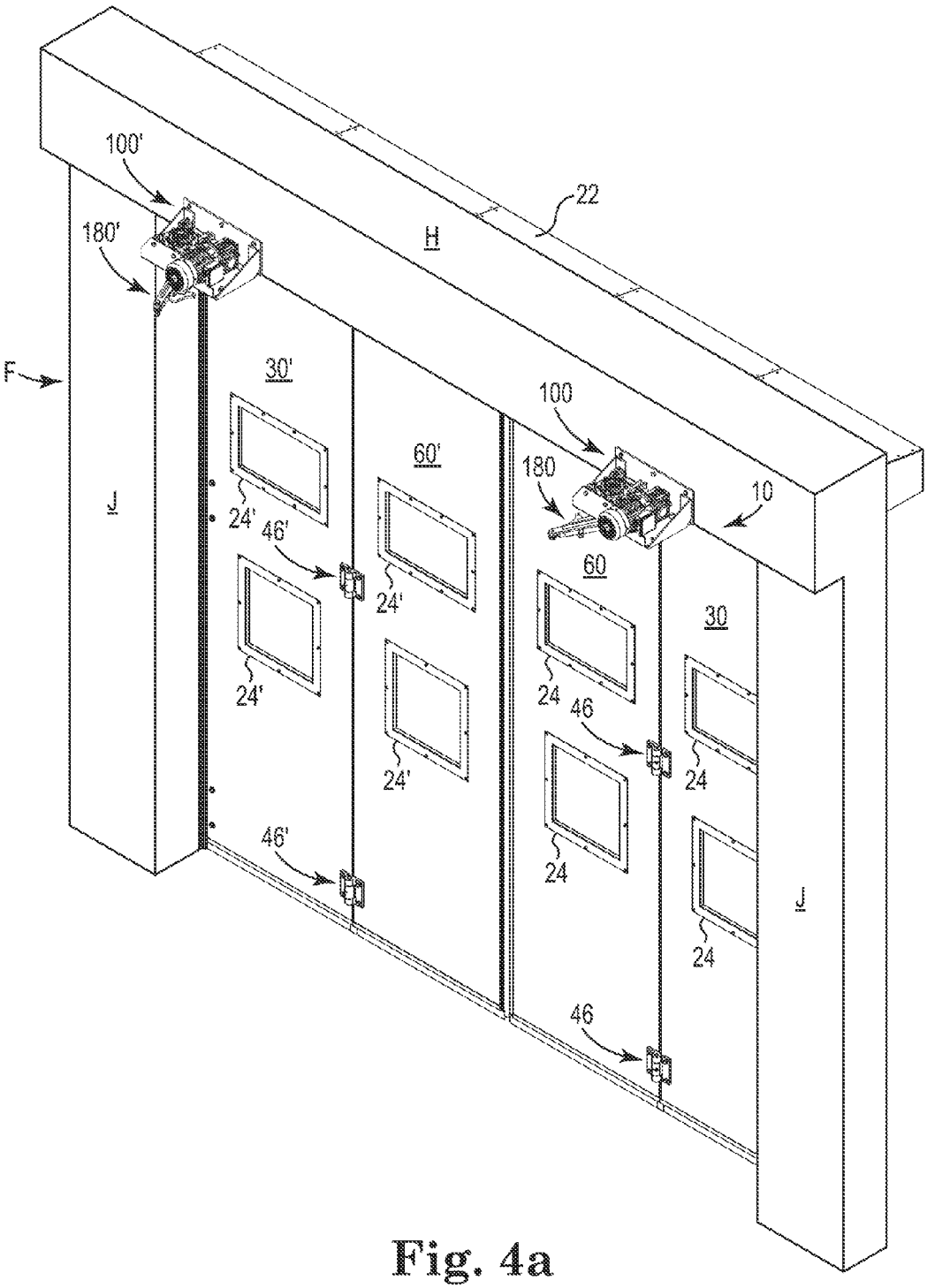
FIG. 4*a* illustrates the door operating system of FIGS. 1-3 in a closed position.
Figure 4B:
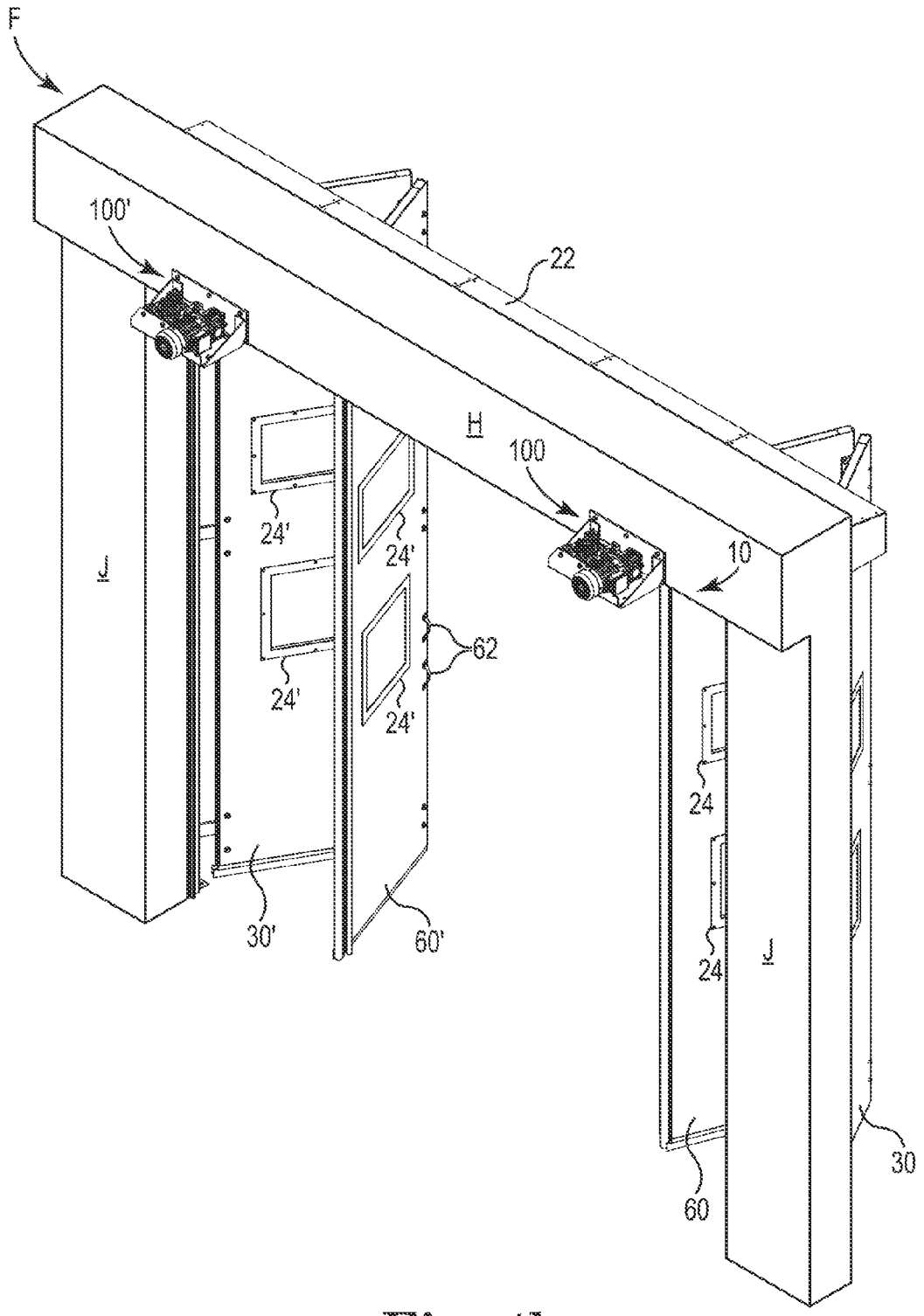
FIG. 4*b* illustrates the door operating system of FIGS. 1-4*a* in an intermediate position.
Figure 4C:
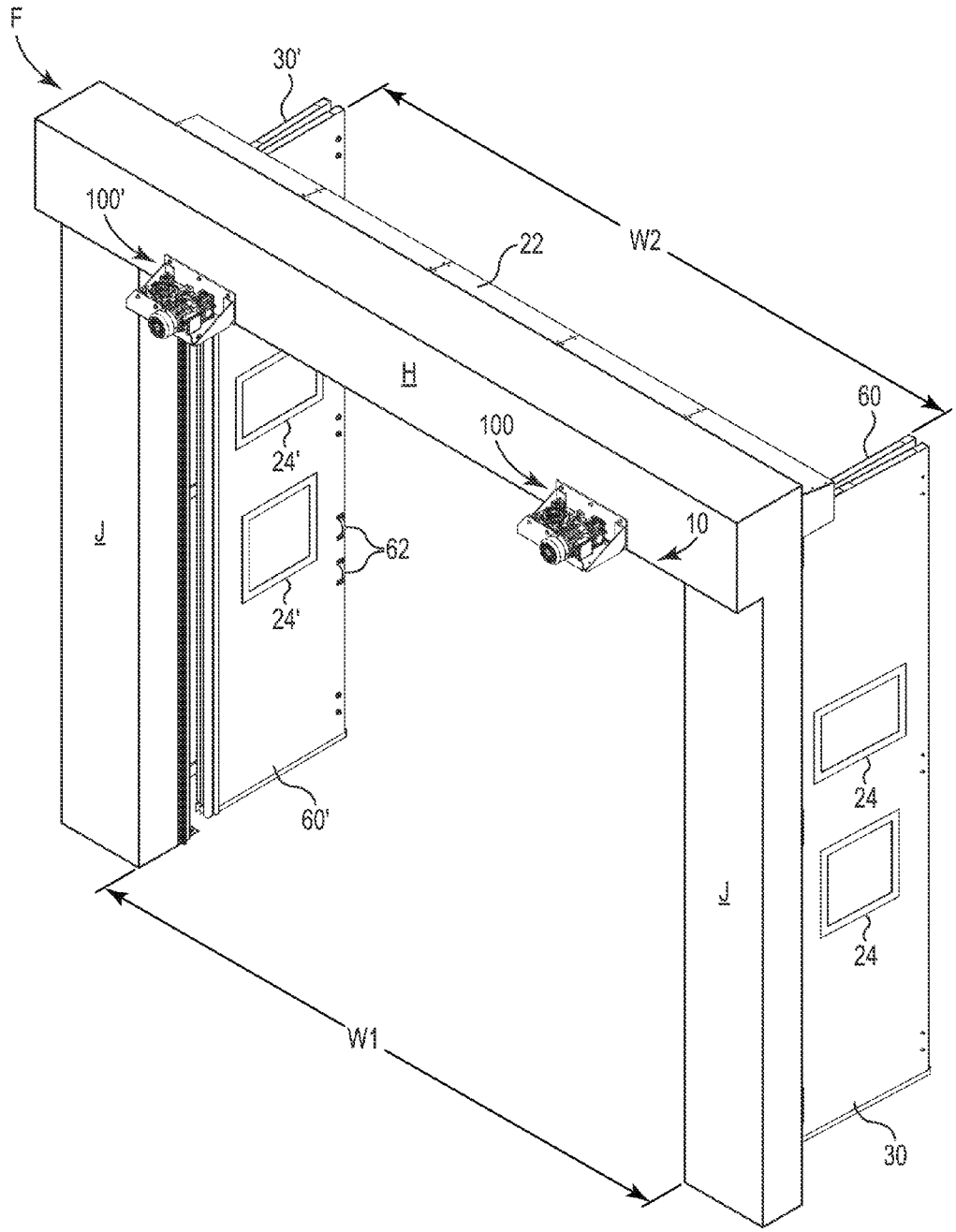
FIG. 4*c* illustrates the door operating system of FIGS. 1-4*b* in an open position.

FIGS. 4*a*, 4*b* and 4*c* depict a sequence of interior views in which the bi-fold doors 20, 20' are moved from a closed position (FIG. 4*a* to an intermediate position (FIG. 4*b*) and finally to an open position (FIG. 4*c*). Note that in preferred embodiments, the bi-fold doors 20, 20' are able to be opened to the approximate width W1 of the existing door frame F of the structure S. This feature is important because many existing door frames cannot be enlarged and the operational width W1 of the door frames F cannot be reduced.

The left bi-fold door 20 and its related operational components are preferably substantially identical in configuration to the right bi-fold door 20' and its related operational components. For that reason, only the left bi-fold door 20 and its related operational components will be discussed in detail with the understanding that the right bi-fold door and its related operational components are a mirror image of the left bi-fold door.

Figure 5A:
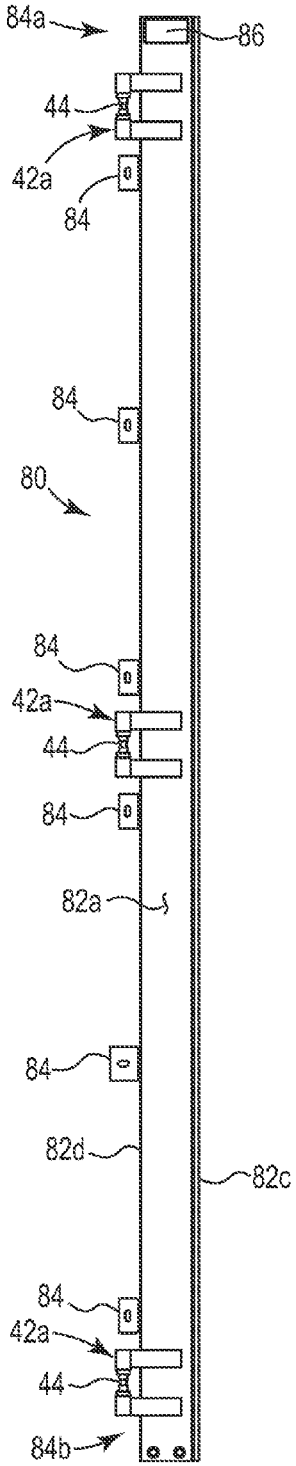
FIG. 5*a* illustrates a preferred secondary left jamb 80 that may be used to support the bi-door 20 of FIGS. 1-4*c;*
Figure 5B:
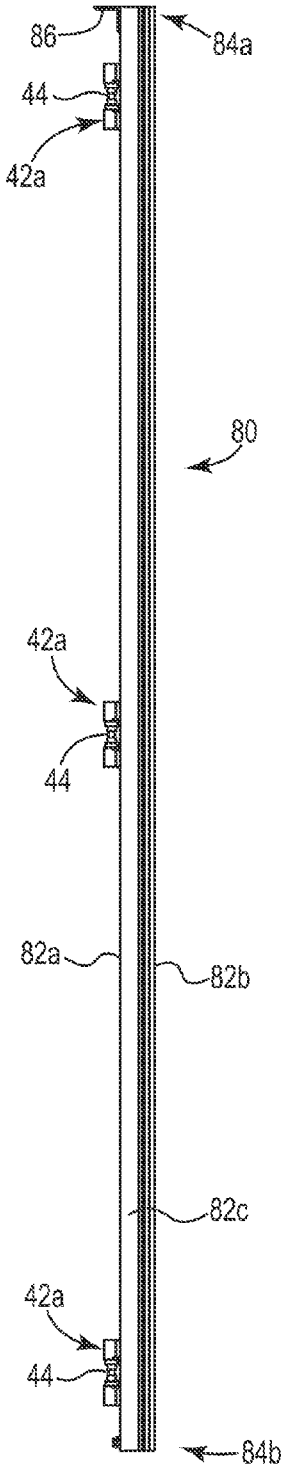
FIG. 5*b* illustrates a preferred secondary left jamb 80 that may be used to support the bi-door 20 of FIGS. 1-4*c;*
Figure 5C:
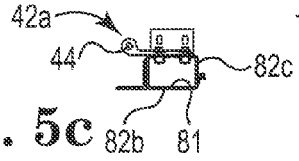
FIG. 5*c* is a top view of the a preferred secondary left jamb 80 that may be used to support the bi-door 20 of FIGS. 1-4*c;*

FIGS. 5*a*, 5*b*, and 5*c* illustrate the preferred secondary left jamb 80 that may be used to support the bi-door 20 of FIG. 1. The secondary left jamb 80 includes elements such as a front surface 82*a*, a rear surface 82*b* spaced therefrom, an inwardly facing side 82*c*, an outwardly facing side 82*d*, a top end 84*a*, and a bottom end 84*b*. The front surface 82*a*, the rear surface 82*b*, the inwardly facing side 82*c*, and the outwardly facing side 82*d* define a hollow frame 81 having a generally rectangular cross-section. As will be understood, the frame 81 need not be hollow and that it may be solid, if desired. The secondary left jamb 80 has a width defined by the outwardly facing side 82*d* and the inwardly facing side 82*c*, and a depth defined by the front surface 82*a* and the rear surface 82*b*.

The front surface 82*a* of the secondary left jamb 80 serves as an attachment point for half portions 42*a* of hinges 40. Note that the half portions 42*a* of the hinges 40 are positioned so that their associated pintles 44 are located forward of the front surface 82*a* and laterally beyond the outwardly facing side 82*d* of the secondary left jamb 80 (see, for example, FIG. 5*c*). The secondary left jamb 80 may be provided with attachment tabs 84 that allow the secondary jamb 80 to be connected to an existing door frame jamb. The attachment tabs 84 may be L-shaped and connected to the outwardly facing side 82*d* of the secondary jamb 80. Preferably, the bottoms of the "L" extend laterally beyond the outwardly facing side 82*d*. More preferably, the bottoms of the "L" are substantially coincident with a plane defined by the rear surface 82*b* of the secondary jamb 80. This allows the secondary jamb 80 to be attached to a flat, exterior surface of a jamb of an existing structure. Note that when the secondary jamb 80 is installed on an existing jamb, the thickness of the secondary jamb positions the half portions of the hinges 40 so that they stand proud of the existing jamb. In addition, an attachment tab 86 may be provided adjacent the top end 84*a* of the secondary left jamb 80. This attachment tab 86 may be connected to the front surface 82*a* at the top end 84*a* of the secondary jamb 80. Preferably, the attachment tab 86 is also "L" shaped. More preferably, the free end of the tab 86 extends forwardly of the front surface 82*a*. In use, the tab 86 may be connected to the hood 22.

Figure 6D:
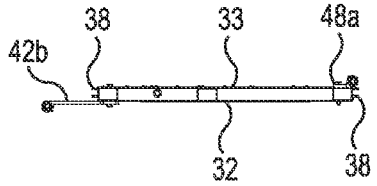
FIG. 6*d* is a top view of a preferred left jamb panel 30 of bi-door 20 of FIGS. 1-4*c;*
Figures 6A, 6B, 6C:
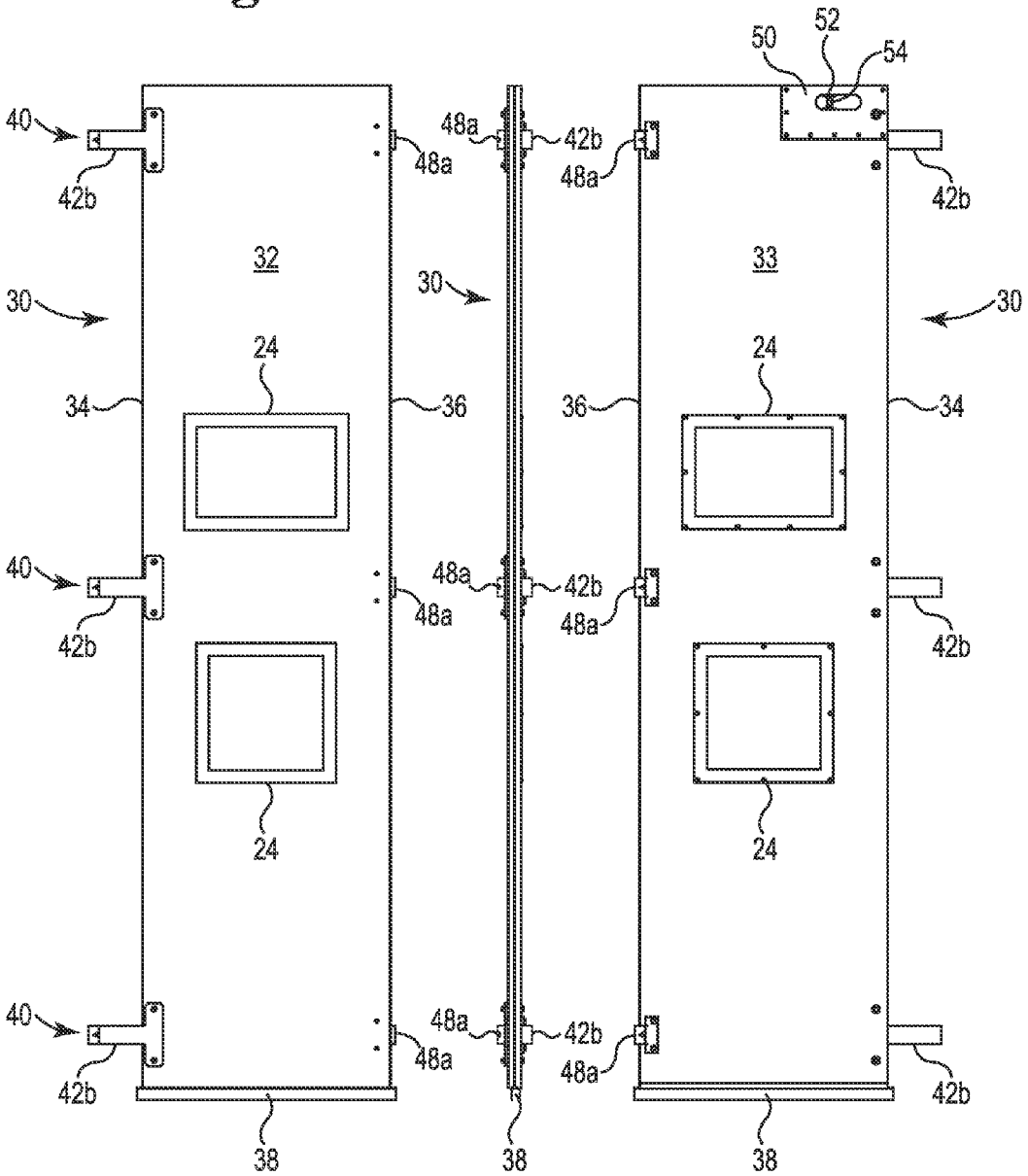
FIG. 6*a* is an exterior view of a preferred left jamb panel 30 of bi-door 20 of FIGS. 1-4*c;*
FIG. 6*b* is a side view of the preferred left jamb panel 30 of bi-door 20 of FIGS. 1-4*c;*
FIG. 6*c* is an interior view of the preferred left jamb panel 30 of bi-door 20 of FIGS. 1-4*c;*
Figure 8D:
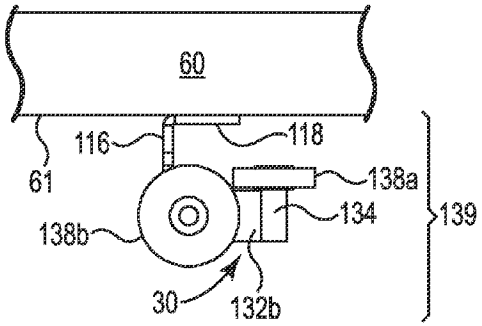
FIG. 8*d* is a top view of the preferred track engagement apparatus 110 for use with the left fold panel 60 of FIGS. 7*a*-7*d;*
Figure 8C:
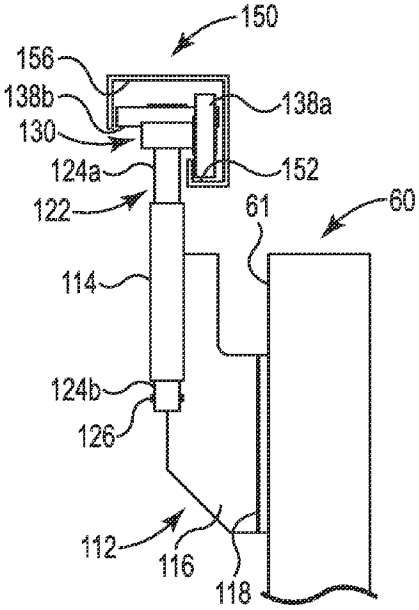
FIG. 8*c* is a side view of the preferred track engagement apparatus 110 for use with the left fold panel 60 of FIGS. 7*a*-7*d;*
Figure 8B:
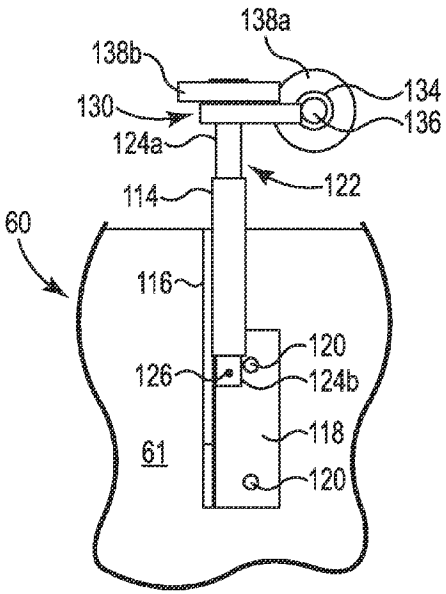
FIG. 8*b* is a front view of the preferred track engagement apparatus 110 for use with the left fold panel 60 of FIGS. 7*a*-7*d;*
Figure 8A:
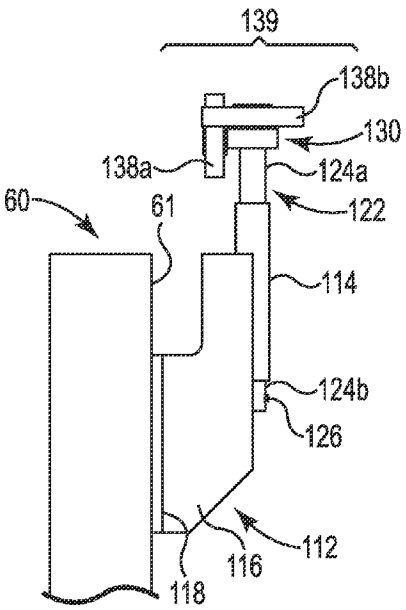
FIG. 8*a* is a side view of the preferred track engagement apparatus 110 for use with the left fold panel 60 of FIGS. 7*a*-7*d;*

FIGS. 6*a*, 6*b*, 6*c* and 6*d* collectively depict the exterior surface view, a side edge view, an interior surface view and a top edge view of preferred left jamb panel 30 of the bi-door 20 of FIG. 1. A first side edge 34 of the exterior facing portion 32 of the jamb panel 30, as best shown in FIGS. 6*a* and 6*c*, depict the general location of half portion 42*b* of the hinges 40 as they extend laterally beyond the first side edge 34 of the jamb panel 30. The half portions 42*b* of the hinges 40 are used to connect the jamb panel 30 to corresponding half portions 42*a* of the hinges that are attached to a secondary jamb, as discussed above. As best shown in FIG. 6*c*, a second side edge 36 of the interior facing portion 33 of the jamb panel 30 depicts the general location of half portions 48*a* of hinges 46 as they extend laterally beyond the second side edge 36 of the jamb panel 30 (see also, FIG. 6*a*). The half portions of the hinges 46 are used to connect the jamb panel 30 to corresponding half portions of the hinges that are attached to the fold panel 60. On the interior side 33 of the jamb panel 30, near the top and at a position between the first and second side edges 34, 36, there is an attachment member (see, FIG. 6*c*) 50. The attachment member 50 is configured and arranged to be operatively connected to a motive source 100, which will be discussed in further detail below. In a preferred embodiment, the attachment member 50 may comprise a u-shaped bracket 52 having a pivot pin 54. In some embodiments, the pivot pin 54 is vertically aligned. The bottom and side edges 34, 36 of the jamb panel 30 may be provided with a weather strip 38, which is best shown in FIG. 6*b*.

FIGS. 7*a*, 7*b*, 7*c* and 7*d* collectively depict an embodiment of the left fold panel 60 of the bi-fold door 20 of FIG. 1. A first side edge 64 of the jamb panel facing portion of the fold panel 60, as best 48*b* of the hinges 46 as they extend laterally beyond the first side edge 64 of the fold panel 60. The half portions 48*b* of the hinges 46 are used to connect the fold panel 60 to corresponding half portions 48*a* of the hinges 46 that are attached to a jamb panel 30, as also discussed above. As best shown in FIGS. 7*a* and 7*c*, a second side edge 66 of the fold panel 60 is configured and arranged to contact the second side edge 66 of a right fold panel 60' (see, for example, FIG. 1). In some embodiments, the second side 76 and the bottom may each be provided with a weather strip 38. On the exterior facing side edge 61 of the fold panel 60, near the top and at a position adjacent the second side there is a fixture 112 that forms part of a track engagement apparatus 110. In an illustrative embodiment, the fixture 112 may include a vertically oriented tube 114 that is positioned so that a portion of the tube 114 is higher than the top edge of the fold panel 60 and a portion of the tube 114 stands proud of the exterior surface (see also, FIGS. 8*a*-8*d*).

FIGS. 8*a*, 8*b*, 8*c* and 8*d* collectively depict the preferred track engagement apparatus 110 for use with the left fold panel 60 of FIGS. 7*a*-7*d*. The fixture 112 may comprise a plate 116 having a flange 118, with the flange 118 being used to connect the fixture 112 to a fold panel 60 with fastening elements such as screws (not shown) that extend through apertures 120. The tube 114 is connected to the plate 116, preferably adjacent to a vertically aligned edge thereof. The tube 114 is configured and arranged to receive a post 122 having a first end 124*a* and a second end 124*b*, with the first end 124*a* of the post 122 extending above a top of the tube 114 and with a second end 124*b* of the post 122 extending below a bottom of the tube 114. The second end 124*b* of the post 122 may be provided with a transverse cotter pin 126 or the like so as to prevent removal of the post 122 upwardly from the tube 114 and yet allow rotational movement of the post 122 within the tube 114. At the first end 124*a* of the post 122, there is a transversely oriented and radially extending beam 130 having a first end 132*a* that is adjacent the post 122, and a second end 132*b* that is spaced away from the post 122. The second end 132*b* of the beam 130 may be provided with barrel 134 that is able to receive an axle 136 and a support wheel 138*a* rotatably mounted thereto. Preferably, the barrel 134 is transversely oriented relative to the longitudinal axis of the beam 130, so that when the beam 130 rotates with the post 122, the support wheel 138*a* is able to swivel back and forth. The support wheel 138*a* is received within an upwardly opening channel 152 of a track 150 (see, FIG. 8*c*). In some embodiments, the first end 132*a* of the beam 130 may include an aperture (not shown) so that it may be frictionally press-fit over the first end 124*a* of the post 122 so that a portion of the first end 124*a* of the post 122 extends therethrough. With such embodiments, the portion of the post 122 that extends through the beam 130 may serve as a vertical axle for a transversely oriented guide wheel 138*b*. In other embodiments, one side of the beam 130 may be connected to the first end 124*a* of the post 122 and the other end of the beam 130 may be provided with a stub axle (not shown) that supports the transversely oriented guide wheel 138*b*. The guide wheel 138*b* is received within the downwardly opening channel 156 of the track 150 (see, FIG. 8*c*). Together, the fixture 112, the support wheel 138*a* and the guide wheel 138*b* of the track engagement apparatus 110 may be collectively referred to as a trolley 139. In operation, the trolley 139 follows a respective angled track segment 150, 150' as a bi-fold door 20 is opened or closed.

Figure 9A:
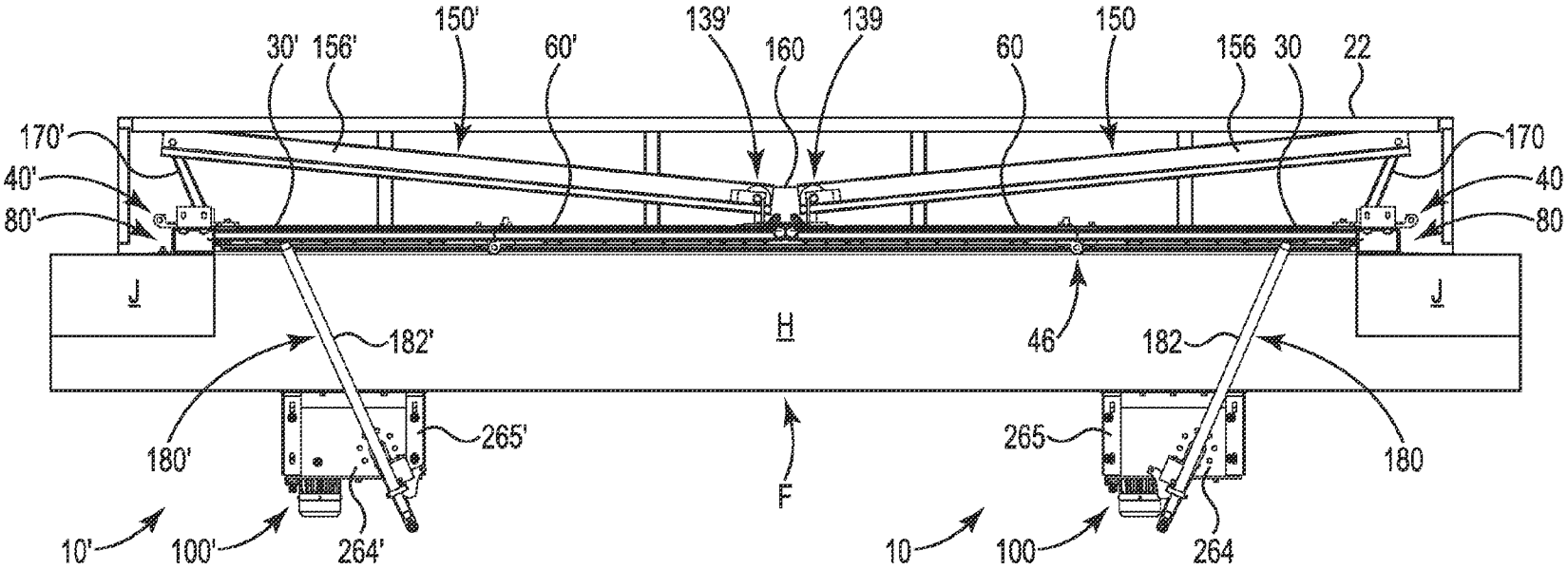
FIG. 9*a* is an upward looking, interior view of the bi-fold doors 20, 20' in a closed position.
Figure 9B:
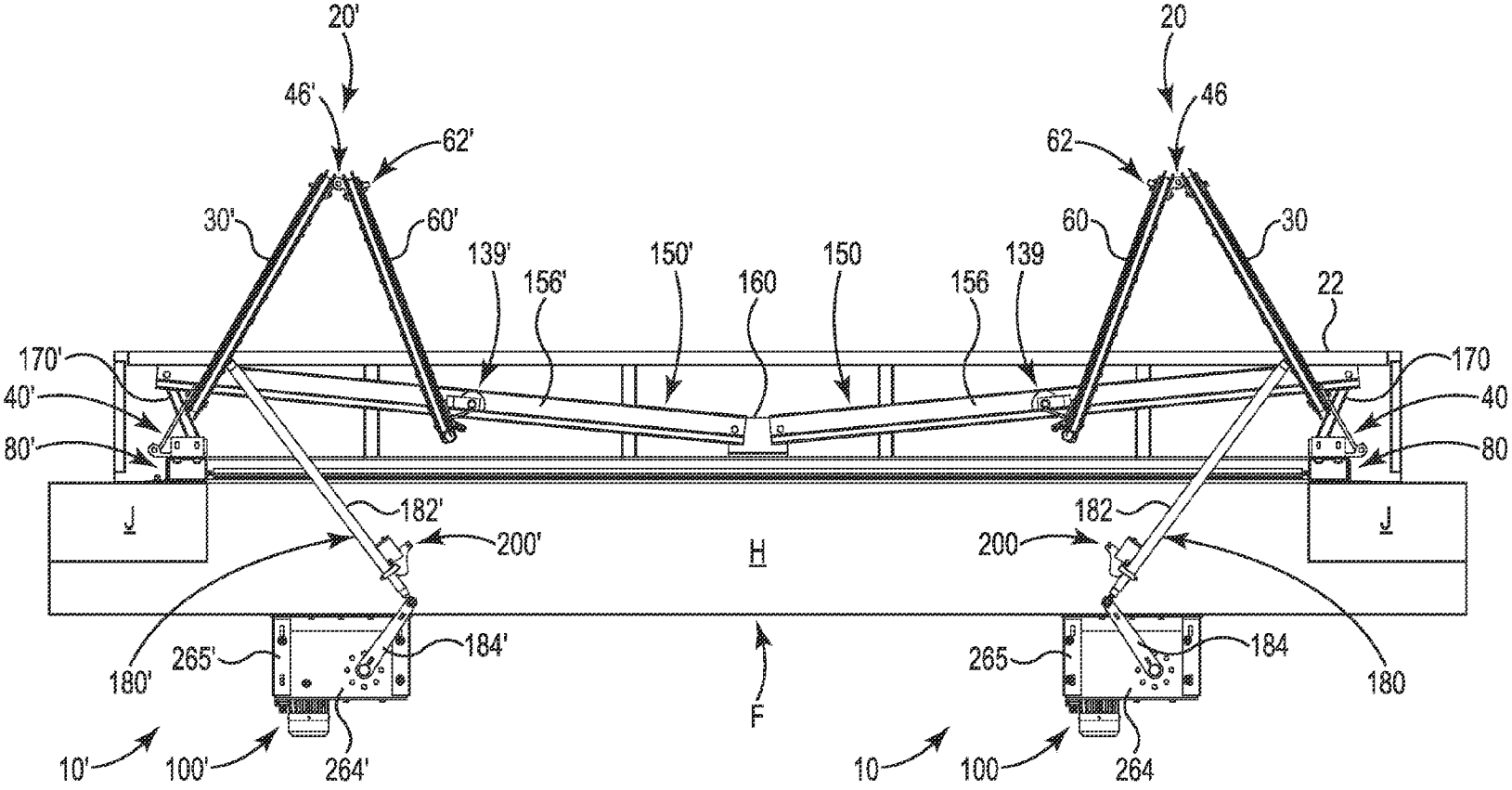
FIG. 9*b* is an upward looking, interior view of the bi-fold doors 20, 20' in an intermediate position.
Figure 9C:
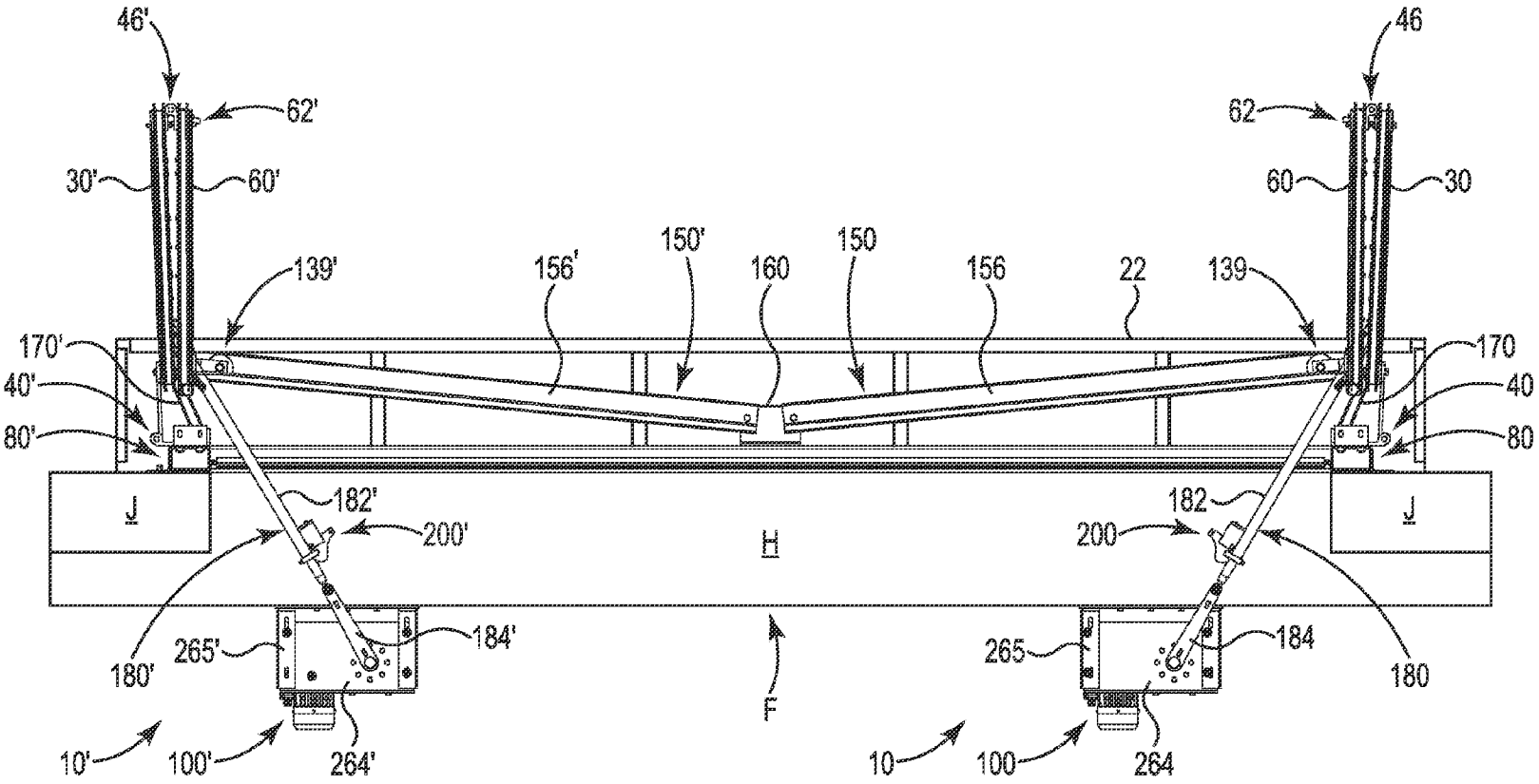
FIG. 9*c* is an upward looking, interior view of the bi-fold doors 20, 20 in an open position.

FIGS. 9*a*, 9*b* and 9*c* collectively depict a sequence of views in which the bi-fold doors 20, 20' are viewed from the bottom and looking up; are moved from a closed position (FIG. 9*a*) to an intermediate position (FIG. 9*b*) and finally to an open position (FIG. 9*c*). Starting with the closed position of the bi-fold doors 20, 20' of FIG. 9*a*, the existing jambs J and header H of a structure frame F can be seen. Each jamb J is provided with a secondary jamb 80, 80' that is connected thereto such that hinges 40, 40' are spaced in front of the existing jambs J. Continuing on, there are left and right tracks 150, 150', each of which has one end that is connected to a center track support 160 and another end that is connected to a strut 170,170'. As best shown in FIGS. 9*b* and 9*c*, the struts 170, 170' serve to effectively compensate for differences in radial distances between the jamb panel 30, 30' and the fold panel 60, 60' as the rotate about their respective hinges 40, 40', 46, 46'. To that end, the struts 170, 170' position the ends of the track segments 150, 150' outwardly in front of the secondary jambs 80, 80'. As will be appreciated, the length of the struts 170, 170' may be different for differently sized door panels and hinges.

Generally, motion to each bi-fold door 20, 20' may be achieved by one or more motive sources 100, 100' and associated linkage assemblies 180, 180'. In a preferred embodiment, each linkage assembly 180, 180' may comprise a connecting rod 182, 182' and a drive arm 184, 184'. As depicted best in FIGS. 9*a*-9*c*, each bi-fold door 20, 20' is provided with its own motive source 100, 100' and linkage assembly 180, 180'. Starting with FIG. 9*a*, the bi-fold doors 20, 20' are in a closed position and the connecting rods 182, 182' of the linkage assemblies 180, 180' can be seen. In FIG. 9*a*, the drive arms 184, 184' of each linkage assembly 180, 180' are obscured by the connecting rods 182, 182'. In this position, the effective length of the linkage assembly 180, 180' is essentially at a minimum. In FIG. 9*b*, the bi-fold doors 20, 20' are partially open and the connecting rods 182, 182' and drive arms 184, 184' of the linkage assemblies 180, 180' can be seen. In FIG. 9*b*, the drive arms 184, 184' have been rotated so that they are no longer obscured by their respective connecting rods 182, 182'. In this intermediate position, the connection between the motive sources 100, 100' and the bi-fold doors 20, 20' can be more readily understood. Preferably, when the bi-fold doors 20, 20' are being opened, the rotation of the drive arm 184 of motive source 100 is clockwise and the rotation of the drive arm 184' of motive source 100' is counterclockwise. And preferably, when the bi-fold doors 20, 20' are being closed, the rotation of the drive arm 184 of motive source 100 is counterclockwise and rotation of the drive arm 184' of motive source 100' is clockwise. This rotational scheme is preferred because it provides the arms 184, 184' with greater mechanical advantages during the initial stages of opening and closing. Other implementations are possible, and a reverse rotational scheme for the arms 184, 184' would not be precluded where it may be necessary, desirable or advantageous. Yet other implementations may also be possible. For example, the drive arms 184, 184' could rotate in the same direction. Or, the drive arms 184, 184' could be rotated in only one direction. In the open position of FIG. 9*c*, the drive arm 184, 184' and connecting rod 182, 182' of each linkage assembly 180, 180' are in linear alignment with each other. The connecting rod 182, 182' does not obscure their respective drive arms 184, 184' and the effective length of the linkage assembly 180, 180' is essentially at a maximum. Note that the bi-fold doors 20, 20' are preferably able to be opened to substantially the width W1 of the existing door frame F of the structure (see, for example, FIG. 4*c*).

Figure 10A:
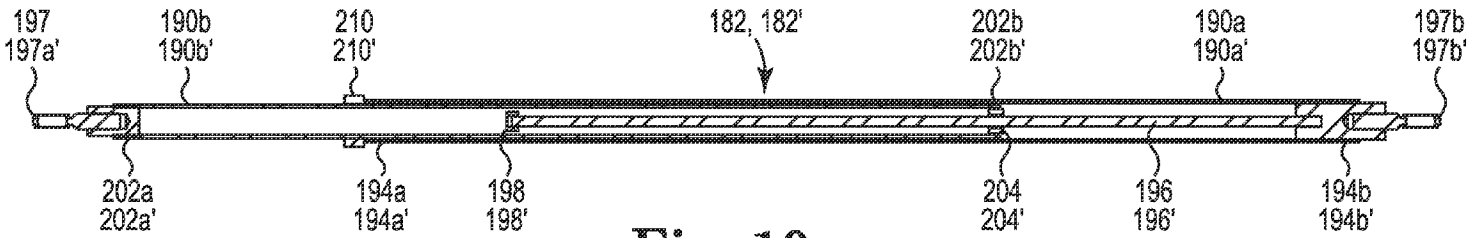
FIG. 10*a* is a cross-sectional view of a connecting rod 182, 182' that may be used with the door opening system 10 of FIGS. 1-4*c* as viewed along line A-A of FIG. 10*b;*
Figure 10B:
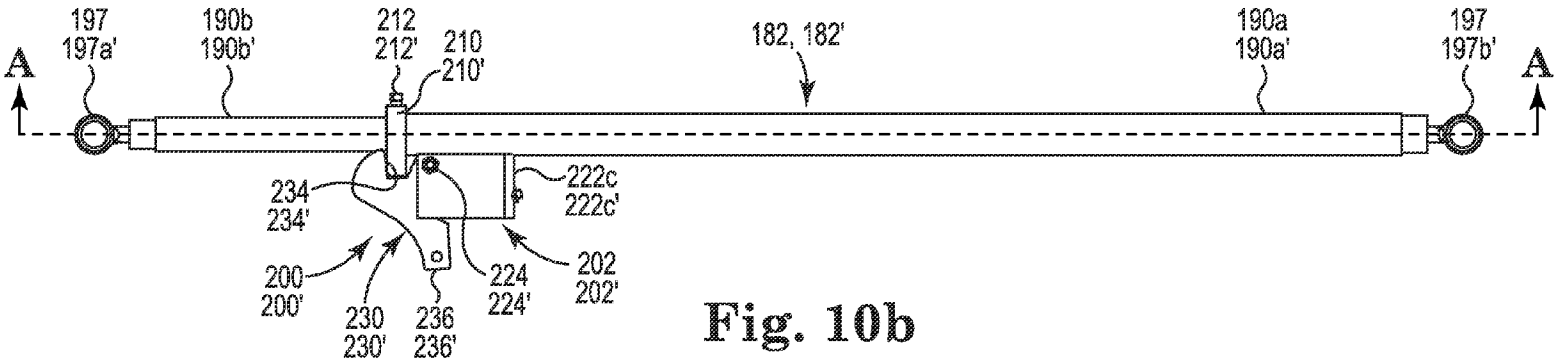
FIG. 10*b* is a plan view of a connecting rod 182, 182' of FIG. 10*a* that may be used with the door opening system 10 of FIGS. 1-4*c;*
Figure 10C:
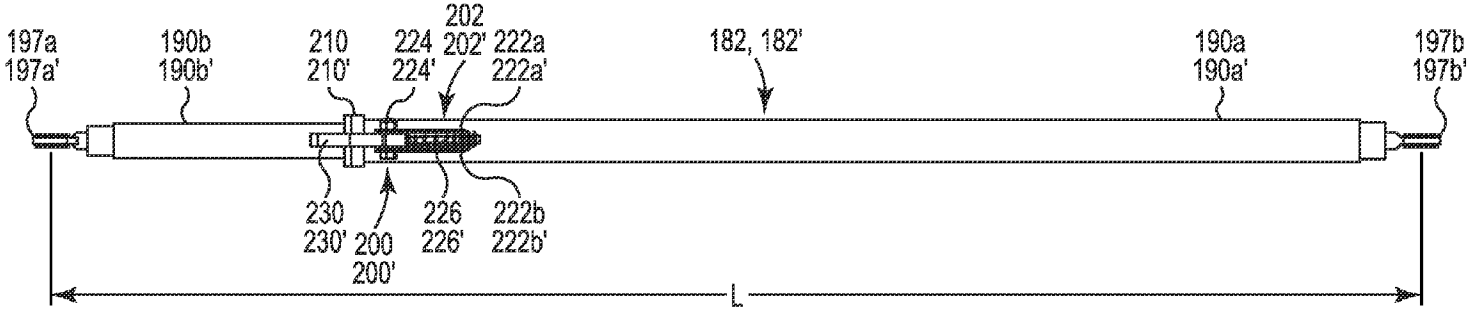
FIG. 10*c* a side view of a connecting rod 182, 182' of FIGS. 10*a*-10*b* that may be used with the door opening system 10.

FIGS. 10*a*, 10*b* and 10*c* collectively depict an embodiment of a connecting rod 182, 182' that may be used with the door opening system 10. Generally, the connecting rod 182, 182' includes an outer tube 190*a*, 190*a'* and an inner tube 190*b*, 190*b'* that are arranged in a telescoping relation so that the effective total length of the rod 182, 182' can be varied. More specifically, the outer tube 190*a*, 190*a'* includes a first end 194*a*. 194*a'*, a second end 194*b*, 194*b'*, an internally situated stem 196, 196', an internally situated stop 198, 198' and a latch assembly 200, 200'. The inner tube 190*b*, 190*b'* includes a first end 202*a*, 202*a'*, a second end 202*b*, 202*b'* and an internally situated ring 204, 204'. The preferred connecting rod 182, 182' also includes a collar 210, 210' having a radially oriented set screw 212, 212'. In its assembled state, the first end 202*a*, 202*a'* of the inner tube 190*b*, 190*b'* and the second end 194*b*, 194*b'* of the outer tube 190*a*, 190*a'* each include a rod end bearing 197*a*, 197*a'*, 197*b*, 197*b'*, with the rod end bearing 197*a*, 197*a'* of the inner tube 190*b*,190*b'* rotatably connectable to the drive arm 184, 184', and with the rod end bearing 197*b*, 197*b'* of the outer tube 190*a*, 190*a'* rotatably connectable to jamb panel 30, 30'. The inner tube 190*b*, 190*b'* is prevented from being removed from the outer tube 190*a*, 190*a'* by the interaction of a ring 204, 204' that is connected to the second end 202*b*, 202*b'* of the inner tube 190*b*, 190*b'* and the stop 198, 198' that is connected to one end of the stem 196, 196'. In operation, the ring 204, 204' has an aperture that is slightly larger than the stem 196, 196', which allows relative movement there between. The aperture of the ring 204, 204', however, is smaller than the stop 198, 198'. This allows the ring 204, 204' to engage with the stop 198, 198' and prevent relative movement therepast. Thus, the inner and outer tubes 190*b*, 190*b'*, 190*a*, 190*a'* are prevented from being separated from each other.

Adjustment of the effective working length L of the connecting rod 182, 182' is accomplished primarily by way of the collar 210, 210' and its associated set screw 212, 212'. Preferably, the collar 210, 210' has an aperture that is sized to admit only the inner tube 190*b*, 190*b'*. When an effective working length L is selected, the collar 210, 210' is secured onto the inner tube 190*b*, 190*b'* by the radially oriented set screw 212, 212'. In operation, the secured collar 210, 210' prevents the portion of the inner tube 190*b*, 190*b'* that extends from the collar 210, 210' to the first end 202*a*, 202*a'* from being inserted into the outer tube 190*a*, 190*a'* (i.e. shortening the effective working length L of the connecting rod 182, 182' when the rod 182, 182' is under axial compression). Conversely, when the connecting rod 182, 182' is under axial tension, movement between the outer and inner tubes 190*a*, 190*a'*, 190*b*, 190*b'* is prevented by the collar 210, 210' and the latch assembly 200, 200'. Preferably, the latch assembly 200, 200' is connected adjacent to the first end 194*a*, 194*a'* of the outer tube 190*a*, 190*a'*. A preferred latch assembly 200, 200' includes a housing 202, 202' that is secured to the outer tube 190*a*, 190*a'*, with the housing 202, 202' including side walls 222*a*, 222*a'*, 222*b*, 222*b'*, a bottom wall 222*c*, 222*c'*, a transversely oriented pivot pin 224, 224' and a spring element 226, 226'. The preferred latch assembly 200, 200' further includes a latch 230, 230', which includes pivot pin aperture (not shown), a jaw 234, 234' and an actuation arm 236, 236'. The latch 230, 230' is rotatably connected to the pivot pin 224, 224' such that the jaw 234, 234' is able to pivot towards or away from the inner tube 190*b*, 190*b'* and be able to engage or be disengaged from the collar 210, 210'. In operation, the jaw 234, 234' is preferentially biased into engagement with the collar 210, 210' by the spring element 226, 226', which is interposed between the bottom wall 222*c*, 222*c'* of the housing 202, 202' and a portion of the latch 230, 230'. When the jaw 234, 234' engages the collar 210, 210', axial movement between the outer and inner tubes 190*a*, 190*a'*, 190*b*, 190*b'* is prevented and the effective working length L of the connecting rod 182, 182' is prevented from being increased. If it becomes necessary to increase the effective working length L of the connecting rod 182, 182', due to maintenance issues, malfunction, or etcetera the jaw 234, 234' of the latch 230, 230' can be released from engagement with the collar 210, 210' by manipulating the actuation arm 236, 236' of the latch 230, 230'.

Figure 11B:
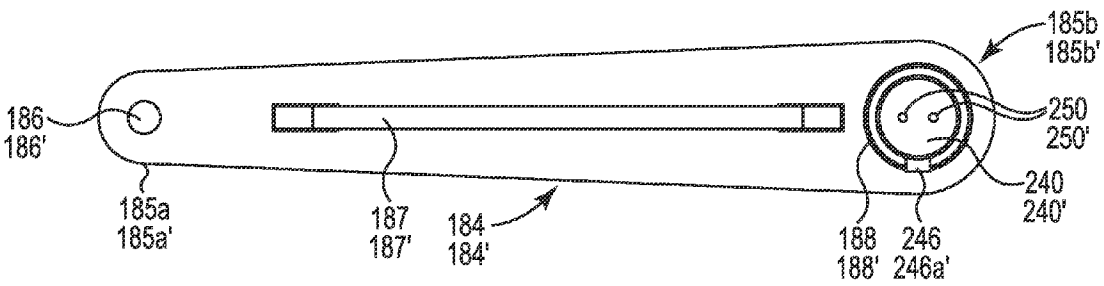
FIG. 11*b* is a view of a preferred drive arm 184, 184' of the preferred door opening system 10.
Figure 11A:
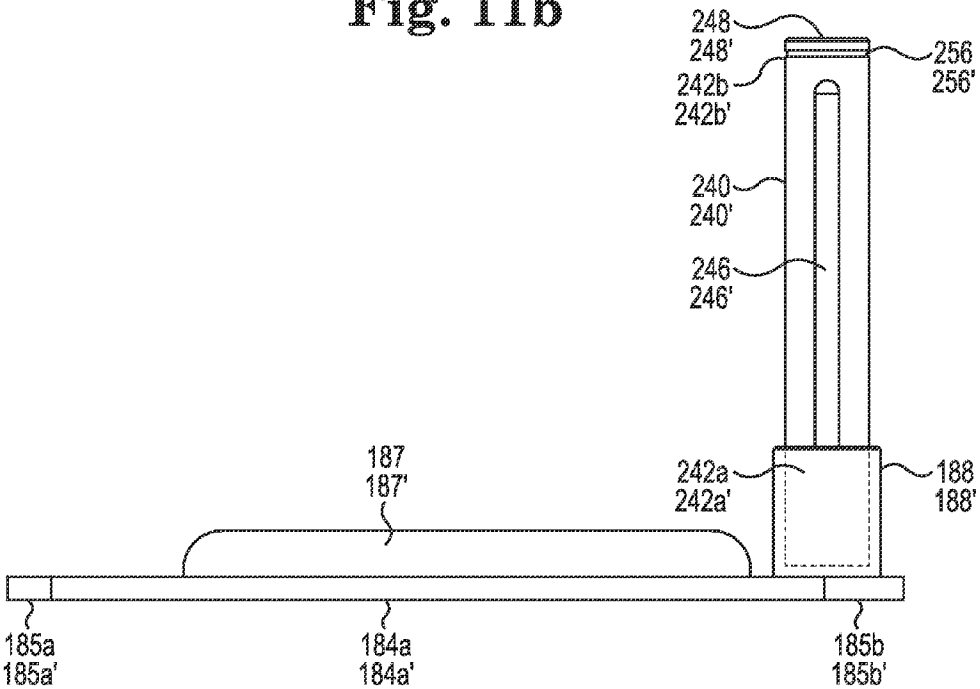
FIG. 11*a* is a view of a preferred drive arm 184, 184' of the preferred door opening system 10.
Figure 11C:
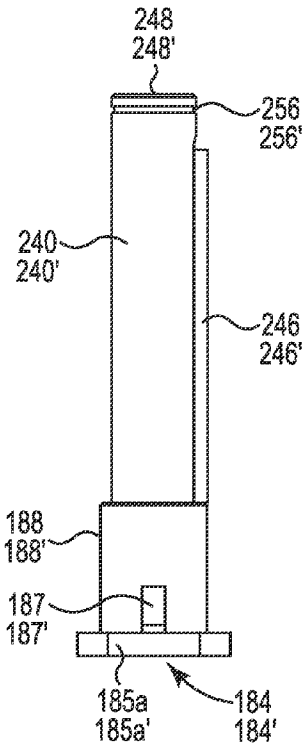
FIG. 11*c* is a view of a preferred drive arm 184, 184' of the preferred door opening system 10.
Figure 12A:
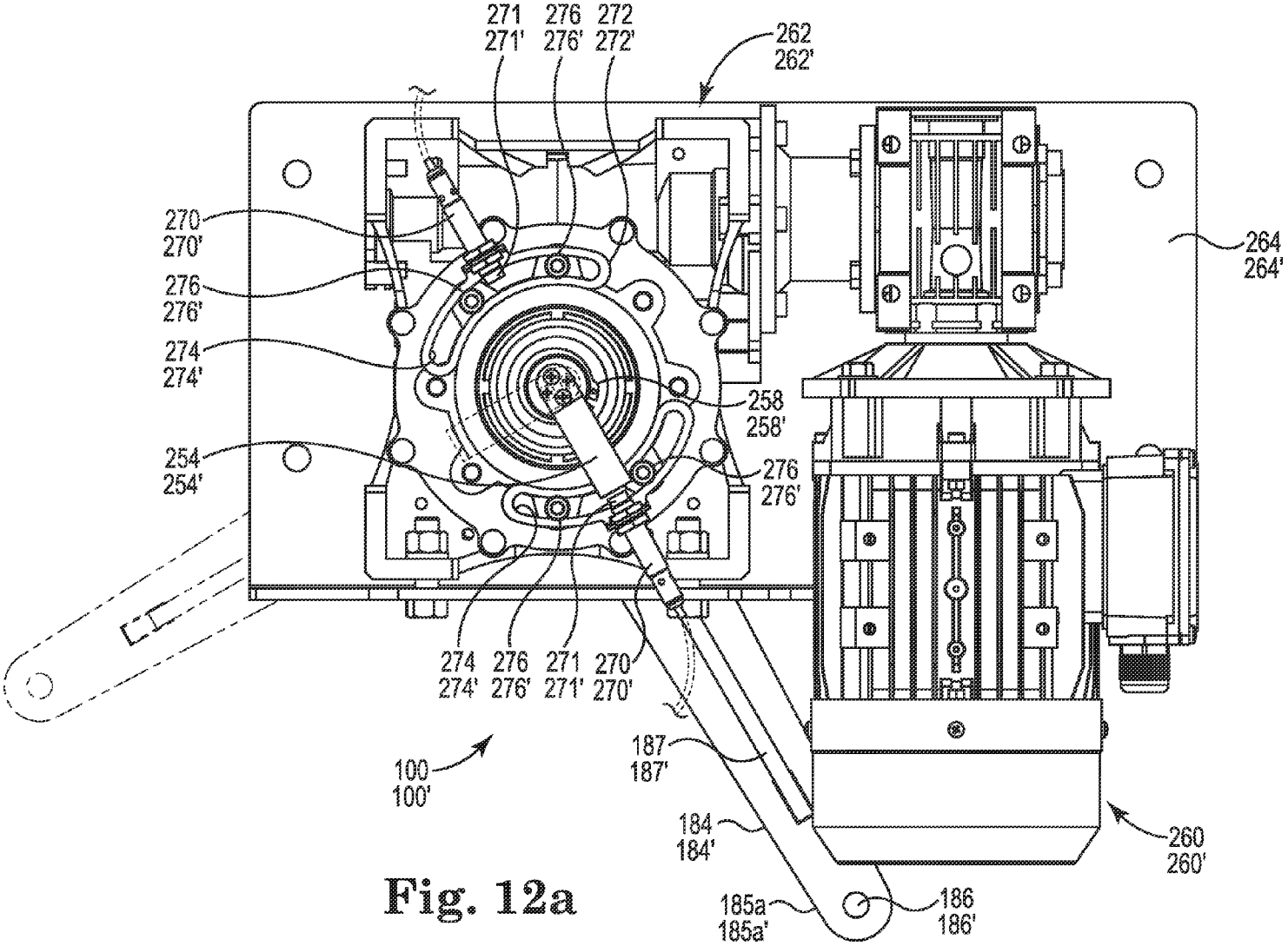
FIG. 12*a* is a top plan view of a preferred motive source 100, 100' of the door opening system 10 of FIGS. 1-4*c;*
Figure 12B:
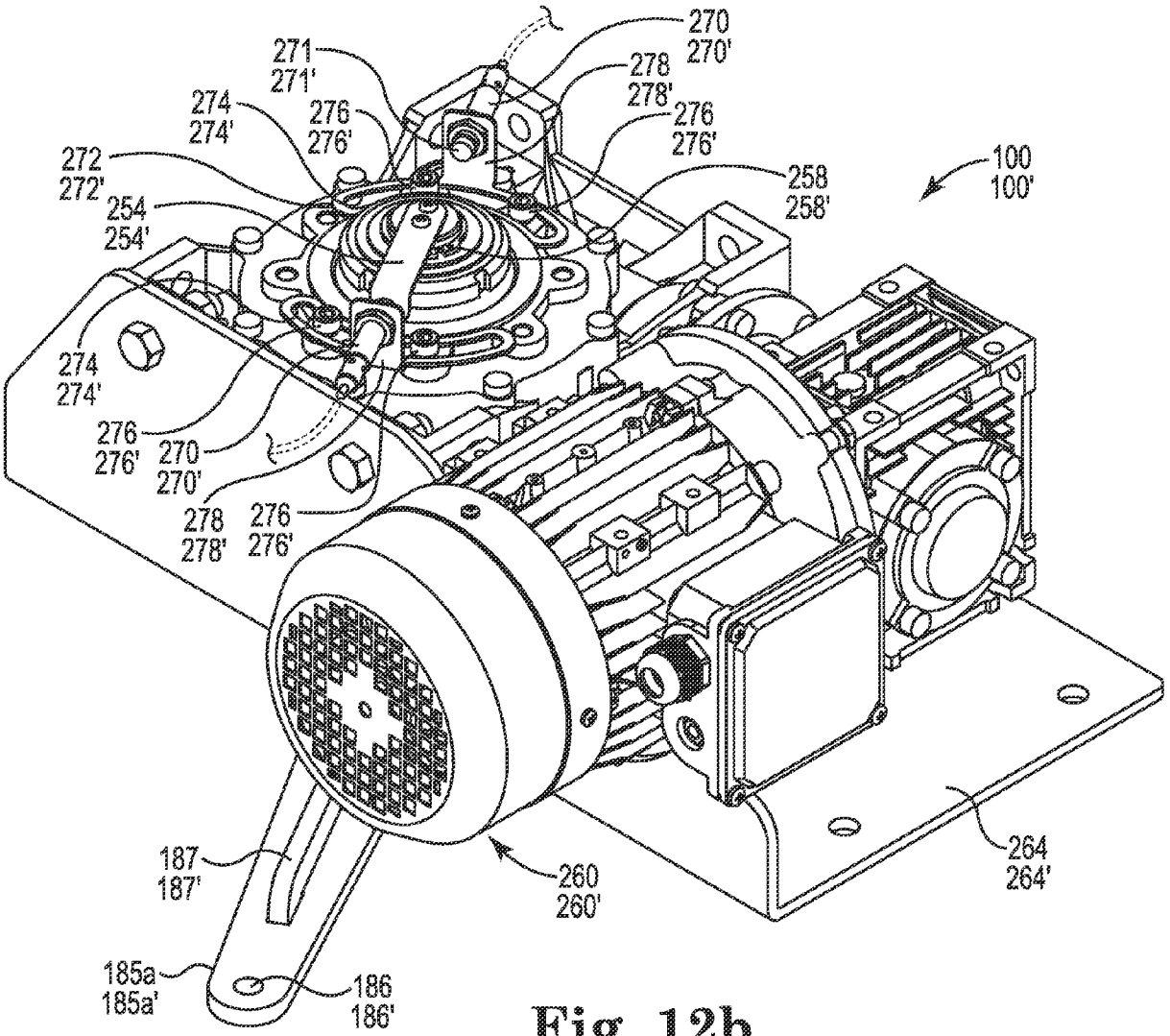
FIG. 12*b* is a perspective view of the preferred motive source 100, 100' of the door opening system 10.
Figure 12C:
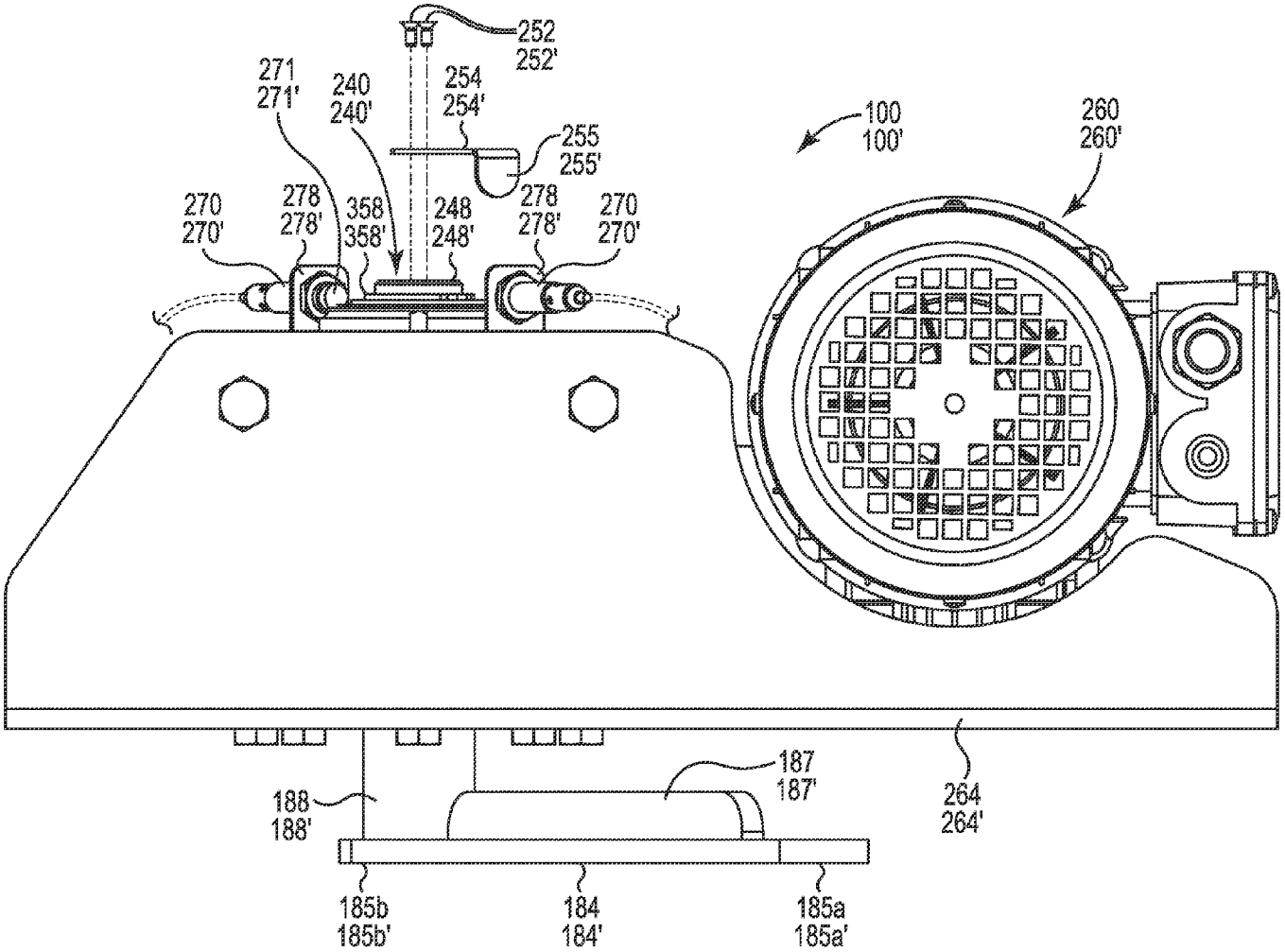
FIG. 12*c* is a front view of the preferred motive source 100, 100' of the door opening system 10.
Figure 12D:
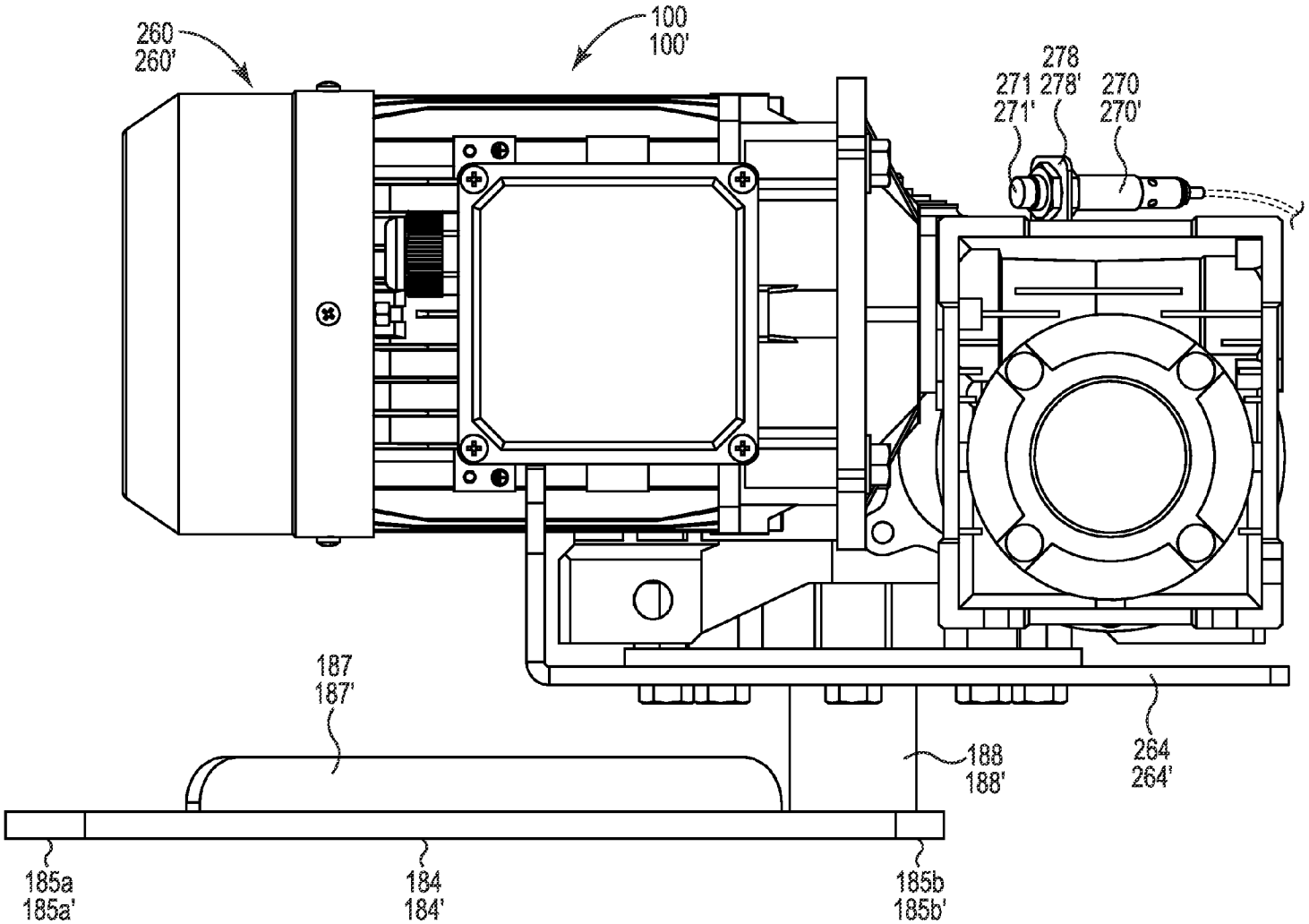
FIG. 12*d* is a side view of the preferred motive source 100, 100' of the door opening system 10.
Figure 12E:
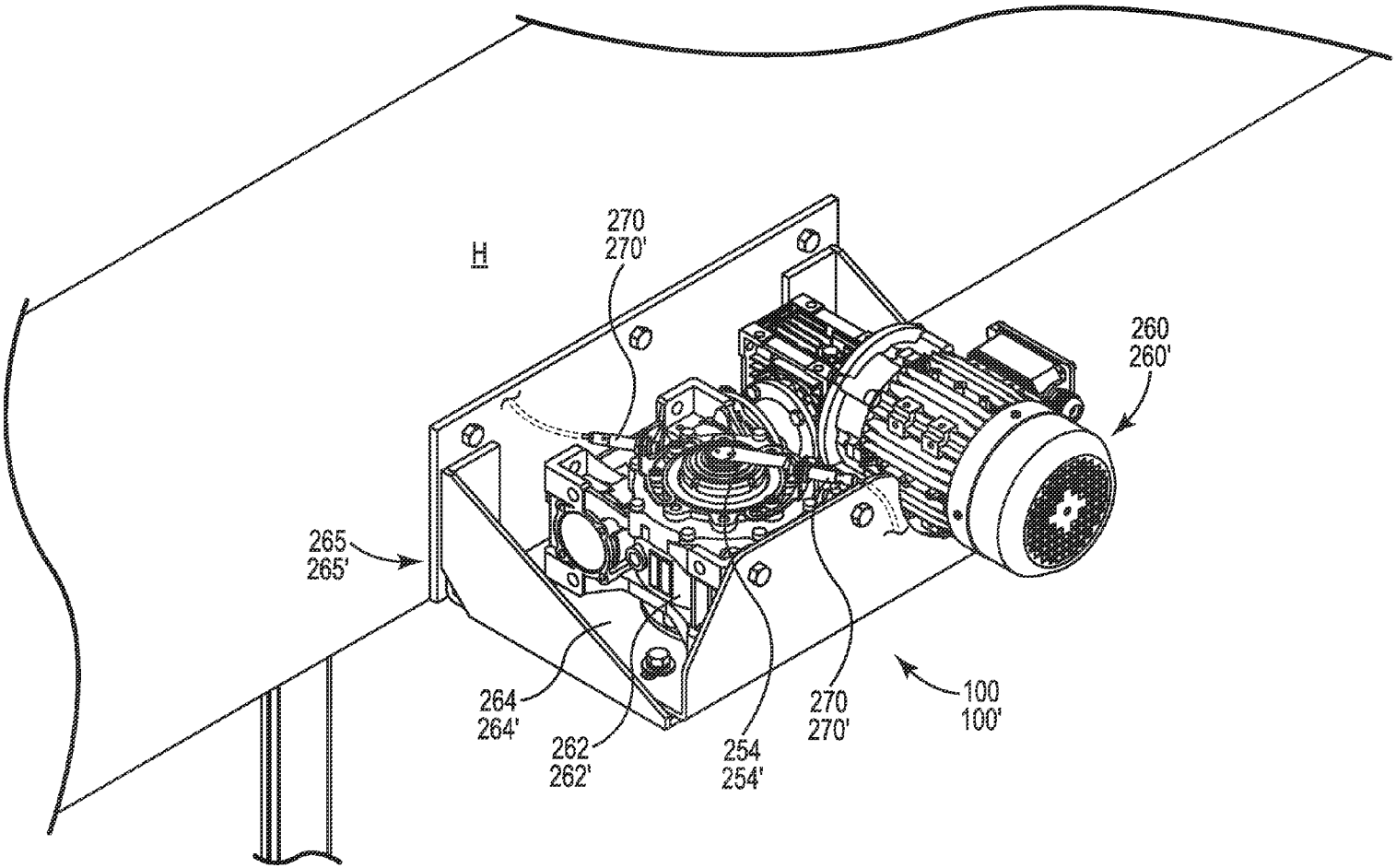
FIG. 12*e* is a perspective view of the preferred motive source 100, 100' of FIGS. 12*a*-12*d*.
Figure 12F:
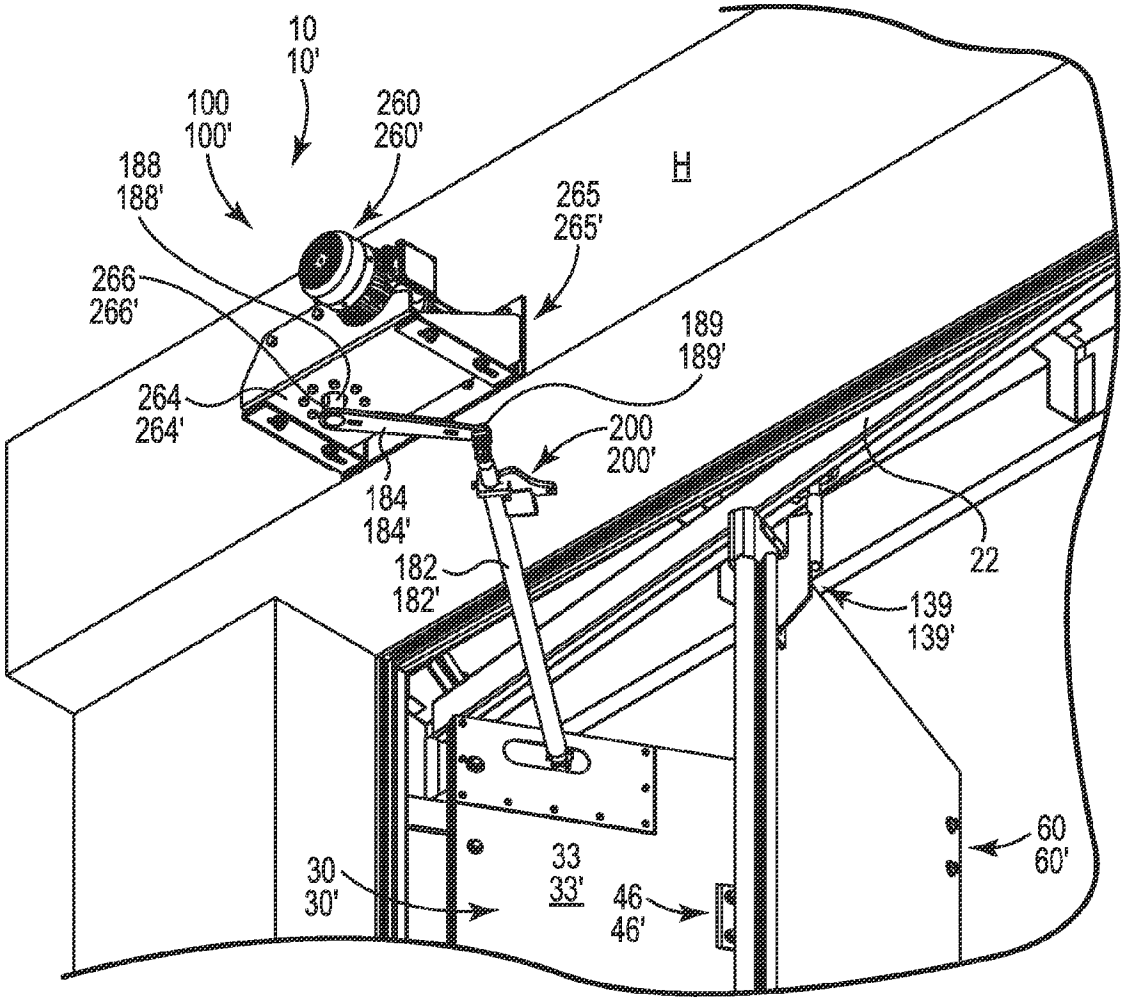
FIG. 12*f* is a perspective view of the preferred motive source 100, 100' of FIGS. 12*a*-12*e* interconnected to the respective bi-door 20, 20'.

FIGS. 11*a*, 11*b* and 11*c* collectively depict the drive arm 184, 184' of the preferred door opening system 10. The drive arm 184, 184', which includes first and second ends 185*a*, 185*a'*, 185*b*, 185*b'* may include aperture 186, 186', a reinforcing bar 187, 187' and socket 188, 188'. Preferably, the aperture 186, 186' is located adjacent the first end 185*a*, 185*a'*, the socket 188, 188' is located adjacent the second end 185*b*, 185*b'*, and the reinforcement bar 187, 187' located between the first and second ends 185*a*, 185*a'*, 185*b*, 185*b'*. The aperture 186, 186' may be provided with a pivot pin 189, 189' or bolt that can be used to connect the first end 185*a*, 185*a'* of the drive arm 184, 184' to the rod end bearing 197*a*, 197*a'* of the first end 202*a*, 202*a'* of the inner tube 190*b*, 190*b'* of the connecting rod 182, 182' (see, for example, FIG. 12*f*). In the embodiment disclosed in FIGS. 11*a*, 11*b* and 11*c*, the socket 188, 188' may be connected to a first end 242*a*, 242*a'* of a drive shaft 240, 240', with the drive shaft 240, 240' connectable to a speed reducer 262, 262' by way of a key 246, 246' that fits into an axial keyway in a hub of the speed reducer 262, 262'. In an alternative embodiment, the socket 188, 188' may be omitted and the drive shaft 240, 240' may be formed from a single blank of material that has been machined so that the first end 242*a*, 242*a*' includes a cylindrical shoulder having a diameter that is larger than the body of the drive shaft 240, 240'. In both embodiments, a second end 242*b*, 242*b*' of the drive shaft 240, 240' includes a transverse surface 248, 248' and one or more threaded apertures 250, 250' that are parallel to the rotational axis of the drive shaft 240, 240'. The threaded apertures 250, 250' are configured to receive threaded fasteners 252, 252' (FIG. 12*c*) that may be used to connect a trigger arm 254, 254' to the end 248, 248' of the shaft 240, 240' so that the arm 254, 254' extends outwardly therefrom in a substantially radial direction. The second end 242*b*, 242*b*' of the shaft 240, 240' also includes a groove 256, 256' that is configured to receive a circlip 258, 258' (FIG. 12*a*). The circlip 258, 258' prevents the second end 242*b*, 242*b*' of the shaft 240, 240 from being pulled down and withdrawn from the speed reducer 262, 262' of the motive source 100, 100', whereas the socket 188, 188' prevents the first end 242*a*, 242*a*' of the shaft 240, 240 from being pulled up through and withdrawn from the speed reducer 262, 262' of the motive source 100, 100'.

FIGS. 12*a*, 12*b*, 12*c*, 12*d* and 12*e* collectively illustrate the preferred motive source 100, 100' of the door opening system 10. The preferred motive source includes a motive source 260, 260' that is connected to a speed reducer 262, 262' to which the shaft 240, 240' is connected. The motive source 260, 260' and the speed reducer 262, 262' of the motive source 100, 100' may be connected to a base 264, 264', with the base having an aperture 266, 266' (FIG. 12*f*) that is large enough to allow shaft 240, 240' to project unencumbered therethrough. A bracket 265, 265' may be used to connect the base 264, 264' a suitable location on a substructure such as a header H of an existing door frame F. Preferably, the motive source 260, 260' and the speed reducer 262, 262' of the motive source 100, 100' may be combined into a single unit. Examples combination motive sources and speed reducers that have been found to be suitable for this application may be obtained from MOTOVARIO of Alpharetta, Ga. Preferred MOTOVARIO model numbers include model number NMRVP/NMRVPL 050-090; model number NMRVP/NMRVPL 050-090; and model number NMRVP/NMRVPL 050-090. It will be understood that other combinations of similar motive sources and speed reducers that are able to provide movement for the doors may be used without departing from the spirit and scope of the invention.

FIGS. 12*a*-12*f* depict the motive source 100, 100' that has been connected to a drive arm 184, 184', wherein the drive shaft 240, 240 has been installed in the speed reducer 262, 262'. Installation of the drive shaft 240, 240' can be accomplished by inserting the second end 242*b*, 242*b*' into a keyed hub (not shown) of the speed reducer 262, 262' from below and driving it upwardly. Upward movement is ultimately prevented by the socket 188, 188', which has a larger diameter than the aperture of the keyed hub. Once the shaft 240, 240 is essentially seated, the second end 242*b*, 242*b*' and its associated groove 256, 256' will project above the other end of the keyed hub. The circlip 258, 258' may then be snapped into place in groove 256, 256' to prevent the drive shaft 240, 240' from being withdrawn from below. The speed reducer 262, 262' may be provided with one or more sensors 270, 270' that are used to detect and control rotation of the drive shaft 240, 240'. In a preferred embodiment, the sensors 270, 270' are connected to a bracket 272, 272', which may be adjustable. Preferably, the bracket 272, 272' is rotatably adjustable and has an axis of rotation that is coincident with the axis of rotation of the drive shaft 240, 240'. The bracket 272, 272' may include one or more arcuately-shaped slots 274, 274' that may receive one or more threaded bolts 276, 276' that engage threaded apertures in the speed reducer 262, 262' casing. The bracket 272, 272' preferably includes one or more flanges 278, 278' to which the sensors 270, 270' may be removably connected. The flanges 278, 278' position the sensors 270, 270' so that they are spaced from and extend radially away from the drive shaft 240, 240. Preferably, the sensors 270, 270' are positioned so that they are in linear alignment with each other and sensing ends 271, 271' face each other.

To facilitate positional detection of the drive shaft 240, 240', a trigger arm 254, 254' is preferably used. The trigger arm 254, 254' is removably connected to the end 248, 248' of the drive shaft 240, 240' by fastening elements 252, 252'. Preferably, the trigger arm 254, 254' includes a downwardly depending finger 255, 255' that is able to swing past in close proximity to a sensing end 271, 271' of a sensor 270, 270' as the drive shaft 240, 240' is rotated. When a sensor 270, 240' detects the presence of the finger 255, 255', the sensor signals the controller 100, 100' to stop. In an exemplary embodiment, it has been found that the suitable results may be obtained by using sensor(s) model no. IME12-04NPOZW2S from company SICK AG of Waldkirch, Germany. It will be understood, though, that other sensors having similar capabilities may be used without departing from the spirit and scope of the invention.

Methods of powering a replacement door that has been operatively connected to an exterior surface of a jamb of a structure having a jamb and a header preferably include providing an motive source 100, 100', providing a linkage assembly 180, 180', connecting the motive source 100, 100' to the header H of the structure, connecting the motive source 100, 100' to one end of a linkage assembly 180, 180'; and then connecting another end of the linkage assembly 180, 180' to an interior facing side 21, 21' of the door 20, 20'.

The invention includes a door opening and closing arrangement or system 10 for use with a structure having a door frame F, a first door 20 and a second door 20', the arrangement or apparatus 10 including a first motive source 100, 100' and a first linkage assembly 180; and a second motive source 100' and a second linkage assembly 180'; wherein the first and second motive sources 100, 100' are attached to an interior facing portion of the door frame F of the structure; wherein the door frame F includes side jambs J that define an opening having predetermined width W1; wherein each of the first and second doors 20, 20' is operatively connected to an exterior facing portion of the door frame F of the structure; wherein the first and second linkage assemblies 180, 180' operatively connect the first and second motive sources 100, 100' to the first and second doors 20, 20', respectively; and wherein the apparatus 10 is able to open the first and second doors 20, 20' such that when the respective door panels 30, 60, 30', 60' are in an open position and stand substantially perpendicular to door frame F, they define a width W2 that is greater than or equal to the width W1 defined by the side jambs J of the frame such that the doors 20, 20' do not impinge within the width W1 defined by the side jambs J of the frame F as is generally illustrated, for example, in FIG. 4*c*.

The invention further includes a method of powering a replacement door that has been operatively connected to an exterior surface of a side jamb of a frame structure having a side jamb and a header, the method comprising the steps of: providing a motive source; providing a linkage assembly; attaching the motive source to the header of the frame structure; connecting the motive source to one end of a linkage assembly; and connecting another end of the linkage assembly to an interior facing side of the door.

The invention further includes a method of retro-fitting a door frame and door of a structure with a door opening and closing apparatus, wherein the door frame includes a side jamb and a header and wherein the door is operatively connected to an exterior facing portion of the side jamb, the method comprising the steps of: providing a motive source; providing a linkage assembly; attaching the motive source to the header of the door frame; connecting the motive source to one end of a linkage assembly; and connecting another end of the linkage assembly to an interior facing side of the door.

The invention further includes a method of retro-fitting a door frame and door of a structure with a door opening and closing apparatus, the method comprising the steps of: providing a supplemental side jamb; providing a motive source; providing a linkage assembly; removing the door and attaching the supplemental side jamb to an exterior facing portion of the side jamb; connecting the door to the supplemental side jamb; attaching the motive source to the header of the structure; connecting the motive source to one end of a linkage assembly; and connecting another end of the linkage assembly to an interior facing side of the door.

The invention further includes a method of retro-fitting a door frame and first and second doors of a structure with a door opening and closing arrangement, wherein the door frame includes side jambs and a header and wherein the doors are operatively connected to an exterior facing portions of the side jambs, the method comprising the steps of: providing a first apparatus having a first motive source and a first linkage assembly; providing a second apparatus having a second motive source and a second linkage assembly; attaching the motive sources to the header of the door frame; connecting the first and second motive sources to one end of the first and second linkage assemblies, respectively; and connecting another end of the first and second linkage assemblies to a respective interior facing side of the first and second doors.

In the claims appended to the original application, the present invention provides an apparatus 10 for use with a structure having an entrance with a frame with side jambs and a door movably connected to one of the side jambs, the apparatus including a motive source and a linkage assembly; wherein the motive source is removably attached to an interior facing portion of the frame; the linkage assembly has a first end that is operatively connected to the motive source; and the linkage assembly has a second end that is operatively connected to the door; whereby when the apparatus is actuated, and the door is moved so that the door is substantially perpendicular to the side jamb to which the door is movably connected, the door does not impinge within a width defined by the side jambs of the frame. In another embodiment, the motive source includes a motor and a transmission, wherein the transmission is operatively connected to the motor. In another embodiment, the apparatus further includes a sensor, wherein the transmission includes an output shaft, and wherein the sensor is configured and arranged so as to detect a first rotational position of the output shaft; wherein the sensor is movably connected to the transmission and adjustable relative thereto. In another embodiment, the apparatus 10 will further include a second sensor, wherein the second sensor is configured and arranged so as to be able to detect a second rotational position of the output shaft. In yet another embodiment, the apparatus will further include a trigger arm, wherein the trigger arm is connected to the output shaft such that when the output shaft rotates, the trigger arm is able to actuate at least one of the sensors. In another embodiment, the apparatus will further include a trigger arm, wherein the trigger arm is connected to the output shaft such that when the output shaft rotates, the trigger arm is able to actuate the sensor. In yet another embodiment, the linkage assembly will further include a drive arm and a connecting rod; wherein the one end of the drive arm is operatively connected to an output shaft of the transmission, wherein another end of the drive arm is operatively connected to one end of the connecting rod, and wherein another end of the connecting rod is operatively connected to an interior facing side of the door; wherein the connecting rod includes an inner tube and an outer tube, and the inner tube and the outer tube are telescopingly adjustable relative to one another, whereby the effective working length of the connecting rod may be adjusted. In another embodiment, the apparatus will further include a collar, wherein the collar is configured and arranged to be able to be secured to the inner tube such that the inner tube is prevented from telescoping into the outer tube. In yet another embodiment, the apparatus will preferably further include a latch assembly, wherein the latch assembly is configured and arranged to be secured to the outer tube, and wherein the latch assembly is configured and arranged to operatively engage the collar and prevent relative movement between the inner and outer tubes, wherein the latch assembly further includes an open-end jaw that can engage a portion of the collar and/or a spring element that urges the open-end jaw into engagement with the collar.

In another embodiment, the present invention further provides an apparatus 10 for use with a structure having a door frame and a door, the apparatus including a motive source and a linkage assembly; wherein the motive source is attached to an interior facing surface of the door frame and the door frame includes side jambs that define an opening having predetermined width; wherein the door is pivotally attached to an exterior facing surface of the door frame; the linkage assembly operatively connects the motive source to the door; and the apparatus is able to open the door such that it defines a width that is greater than or equal to the width defined by the side jambs of the frame. In another embodiment, the motive source further includes a motor and a transmission, wherein the transmission is operatively connected to the motive source and wherein the door includes two panels that are pivotally connected to each other.

In another embodiment, the present invention provides a method of retro-fitting a door frame and door of a structure with a door opening and closing apparatus, wherein the door frame includes a side jamb and a header and wherein the door is operatively connected to an exterior facing portion of the side jamb; the method including the steps of providing a motive source; providing a linkage assembly; attaching the motive source to the header of the door frame; connecting the motive source to one end of a linkage assembly; and connecting another end of the linkage assembly to an interior facing side of the door.

It is to be understood, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus for attachment to a structure having an entrance to an interior, the entrance being defined by a frame having a header and two side jambs, the header and each of the respective side jambs having an interior facing portion facing the interior of the structure and an exterior facing portion facing the exterior of the structure; wherein the respective side jambs also have inwardly facing sides and outwardly facing sides; wherein the respective inwardly facing sides of the respective side jambs define an opening having a predetermined width, the apparatus comprising:

a door that is pivotally connected to the exterior facing portion of one of the respective side jambs by a hinge; wherein the hinge is attached to the respective side jamb such the door can pivot at a pivot point that is spaced apart from and positioned outside of the outwardly facing side of the respective side jamb;

a motive source; and a linkage assembly; wherein the motive source is removably attached to one of the respective interior facing portions of the frame and the door is pivotally attached to one of the respective exterior facing portions of the frame; wherein the linkage assembly has a first end that is operatively connected to the motive source and the linkage assembly has a second end that is operatively connected to the door;

wherein the door is moved from a closed position to an open position so that the door is substantially perpendicular to the side jamb to which the door is movably connected, and the door does not impinge within the predetermined width of the opening defined by the side jambs of the frame in the open position.

2. The apparatus of claim 1, wherein the motive source comprises a motor and a transmission, wherein the transmission is operatively connected to the motor.

3. The apparatus of claim 2, wherein the apparatus further comprises a sensor, wherein the transmission includes an output shaft, and wherein the sensor is configured and arranged so as to detect a first rotational position of the output shaft.

4. The apparatus of claim 3, wherein the sensor is movably connected to the transmission and adjustable relative thereto.

5. The apparatus of claim 3, further comprising a second sensor, wherein the second sensor is configured and arranged so as to be able to detect a second rotational position of the output shaft.

6. The apparatus of claim 5, further comprising a trigger arm, wherein the trigger arm is connected to the output shaft such that when the output shaft rotates, the trigger arm is able to actuate at least one of the sensors.

7. The apparatus of claim 3, further comprising a trigger arm, wherein the trigger arm is connected to the output shaft such that when the output shaft rotates, the trigger arm is able to actuate the sensor.

8. The apparatus of claim 2, wherein the linkage assembly comprises a drive arm and a connecting rod; wherein the one end of the drive arm is operatively connected to an output shaft of the transmission, wherein another end of the drive arm is operatively connected to one end of the connecting rod, and wherein another end of the connecting rod is operatively connected to an interior facing side of the door.

9. The apparatus of claim 8, wherein the connecting rod comprises an inner tube and an outer tube, wherein the inner tube and the outer tube are telescopingly adjustable relative to each other, whereby the effective working length of the connecting rod may be adjusted.

10. The apparatus of claim 9, further comprising a collar, wherein the collar is configured and arranged to be able to be secured to the inner tube such that the inner tube is prevented from telescoping into the outer tube.

11. The apparatus of claim 10, further comprising a latch assembly, wherein the latch assembly is configured and arranged to be secured to the outer tube, and wherein the latch assembly is configured and arranged to operatively engage the collar and prevent relative movement between the inner and outer tubes.

12. The apparatus of claim 11, wherein the latch assembly comprises an open-end jaw that can engage a portion of the collar.

13. The apparatus of claim 11, wherein the latch assembly further comprises a spring element that urges the open-end jaw into engagement with the collar.

14. An apparatus attached to a structure having an interior and an exterior and a door frame, the door frame including two side jambs, each of which have an interior facing portion facing the interior of the structure and an exterior facing portion facing the exterior of the structure; wherein each of the respective side iambs also have inwardly facing sides and outwardly facing sides; wherein the respective inwardly facing sides of the respective side jambs define an opening having a predetermined width, the apparatus comprising:

two bi-fold doors; wherein each of the respective bi-fold doors is pivotally connected to the exterior facing portion of one of the respective side iambs by a hinge; wherein the hinge is attached to the respective side iamb such the door can pivot at a pivot point that is spaced apart from and positioned outside of the outwardly facing side of the respective side jamb;

a motive source; and a linkage assembly;

wherein the motive source is attached to an interior facing surface of the door frame; the respective bi-fold doors are each respectively pivotally attached to an exterior facing surface of the door frame; and the linkage assembly operatively connects the motive source to one of the bi-fold doors so that the motive source is able to move the respective bi-fold door to which the linkage is attached from a closed position to an open position; wherein, in the open position, a first distance between the respective bi-fold doors defines a width that is greater than or equal to the predetermined width of the opening defined by the side jambs of the frame.

15. The apparatus of claim 14, wherein the motive source comprises a motor and a transmission, and the transmission is operatively connected to the motive source.

16. The apparatus of claim 14, wherein the bi-fold door comprises two panels that are pivotally connected to each other.

17. A method of retro-fitting a door frame of a structure with a door opening and closing apparatus, wherein the door frame includes a header and two opposing side jambs; the side jambs each having an interior facing portion and an exterior facing portion and the header having an interior facing portion; wherein each of the respective side iambs also have inwardly facing sides and outwardly facing sides; wherein the respective inwardly facing sides of the respective side jambs define an opening having a predetermined width, the method comprising the steps of:

a) providing two bi-fold doors, a hinge for securing each of the bi-fold doors to the respective side iambs and a motive source including a linkage assembly, the linkage assembly having first and second ends; the motive source being interconnected with the first end of a linkage assembly;

b) attaching the motive source to the interior facing portion of the header;

c) pivotally securing each of the respective bi-fold doors to the exterior facing portion of the respective side jambs with the respective hinge; and d) interconnecting the second end of the linkage assembly to an interior facing side of one of the respective bi-fold doors so that the motive source can move the respective bi-fold door from a closed position to an open position; wherein the hinge pivotally securing each of the respective bi-fold doors to each of the respective side jambs is attached to the respective side jamb such the respective bi-fold door can pivot at a pivot point that is spaced apart from and positioned outside of the outwardly facing side of the respective side jamb.

18. The method of retro-fitting a door frame of a structure of claim 17, further comprises providing a secondary iamb for attachment to each of the respective side jambs; wherein the step of pivotally securing each of the respective bi-fold doors to the exterior facing portion of each of the respective side iambs includes securing respective secondary jambs to each of the respective side jambs proximate each of the respective exterior facing portions of the each of the respective side jambs and pivotally securing each of the respective bi-fold doors to the respective secondary jambs so that each of the respective bi-fold doors can pivot outwardly away from the respective exterior facing portion.

19. A door apparatus for attachment to a door frame of an entrance to a building structure, the building structure having an interior and an exterior; the door frame having left and right side jambs, wherein each of the respective side jambs have an interior facing portion and an exterior facing portion; wherein each of the respective side iambs also have inwardly facing sides and outwardly facing sides; wherein the respective inwardly facing sides of the respective side jambs define an opening having a predetermined width, the door apparatus comprising:

a pair of secondary jambs including a secondary left jamb for attachment to the exterior facing portion of the left side jamb and a secondary right jamb for attachment to the exterior facing portion of the right side jamb;

a pair of bi-fold doors including a left door for pivotal connection to the secondary left jamb and a right door for pivotal connection to the secondary right jamb, each bi-fold door having a jamb panel and a fold panel, wherein the fold panel of each of the bi-fold doors is pivotally interconnected to the jamb panel and the jamb panel of each of the bi-fold doors is pivotally interconnected with the respective secondary jamb by a hinge; wherein, when each of the bi-fold doors are pivotally connected to the respective secondary jambs and the respective secondary jambs are attached to the respective exterior facing portions of the respective side jambs, the respective bi-fold doors can reside in a position selected from the group consisting of a closed position and an open position; wherein, when each of the respective bi-fold doors are in the open position, the bi-fold doors will reside in the exterior and a first distance between the respective bi-fold doors will be equal to or greater than the width of the opening; wherein the hinge pivotally securing each of the respective bi-fold doors to each of the respective secondary iambs is attached to the respective secondary jamb such the respective bi-fold door can pivot at a pivot point that is spaced apart from and positioned outside of the outwardly facing side of the respective side jamb to which the respective secondary jamb is secured; and a motive source having a linkage assembly, wherein the motive source is interconnected to the building structure so that it resides within the interior and the linkage assembly is interconnected to one of the bi-fold doors, such that the motive source can move the bi-fold door from the closed position to the open position; wherein the first distance between the respective bi-fold doors when the bi-fold doors are in the open position will be at least equal to the width of the opening.

20. The door apparatus of claim 19; wherein the motive source resides within the interior and the bi-fold door to which the linkage assembly is interconnected is located in the exterior when the bi-fold door is in the open position.

21. The door apparatus of claim 19; wherein the bi-fold door to which the linkage assembly is interconnected is located in the exterior when the bi-fold door is in the open position and wherein the bi-fold door pivots away from the entrance on hinges secured to a secondary jamb proximate the respective side jamb of the door frame.

* * * * *